US005560467A

United States Patent [19]

Takemoto et al.

[11] Patent Number: 5,560,467

[45] Date of Patent: Oct. 1, 1996

[54] EXCHANGE MACHINE HAVING BANK NOTE QUALIFICATION DETERMINING CAPACITY

[75] Inventors: Takatoshi Takemoto, Tokyo; Noriaki Kano, Hanamaki; Ren Aoki, Hanamaki; Eiji Ito, Hanamaki; Hiroyasu Obara, Hanamaki; Mitsuhiro Tada, Hanamaki; Koji Murakami, Hanamaki; Shoushichi Takahashi, Kitakami, all of Japan

[73] Assignee: Kabushiki Kaisha Ace Denken, Tokyo, Japan

[21] Appl. No.: 211,549

[22] PCT Filed: Oct. 8, 1992

[86] PCT No.: PCT/JP92/01306

§ 371 Date: Apr. 8, 1994

§ 102(e) Date: Apr. 8, 1994

[87] PCT Pub. No.: WO93/07588

PCT Pub. Date: Apr. 15, 1993

[30] Foreign Application Priority Data

Oct. 8, 1991 [JP] Japan ..... 3-260876
Oct. 8, 1991 [JP] Japan ..... 3-260878

[51] Int. Cl.[6] ..... G07F 7/04

[52] U.S. Cl. ..... 194/207; 209/534; 271/185; 271/251

[58] Field of Search ..... 194/207; 209/534, 209/588; 271/184, 185, 251, 261

[56] References Cited

U.S. PATENT DOCUMENTS

| | | | |
|---|---|---|---|
| 2,190,413 | 2/1940 | Davidson | 271/251 |
| 3,782,543 | 1/1974 | Martelli et al. | 209/588 X |
| 4,437,571 | 3/1984 | Ohmura | 209/534 X |
| 4,473,157 | 9/1984 | Hirose et al. | 209/534 |
| 4,623,975 | 11/1986 | Kagami | 209/534 X |
| 4,705,157 | 11/1987 | Bowles | 271/184 X |
| 5,158,274 | 10/1992 | Hamada et al. | 271/225 X |
| 5,163,672 | 11/1992 | Mennie | 271/187 |
| 5,224,696 | 7/1993 | Kellum | 271/251 X |

FOREIGN PATENT DOCUMENTS

| | | |
|---|---|---|
| 0024704 | 3/1981 | European Pat. Off. . |
| 0072237 | 2/1983 | European Pat. Off. . |
| 0106277 | 4/1984 | European Pat. Off. . |
| 0106278 | 4/1984 | European Pat. Off. . |
| 0308057 | 3/1989 | European Pat. Off. . |
| 0346577 | 12/1989 | European Pat. Off. . |
| 52-42195 | 9/1975 | Japan . |
| 52-42196 | 9/1975 | Japan . |
| 59-3694 | 1/1984 | Japan . |
| 60-5996 | 2/1985 | Japan . |
| 62-5153 | 2/1985 | Japan . |
| 61-92651 | 6/1986 | Japan . |
| 62-21667 | 1/1987 | Japan . |
| 62-151671 | 9/1987 | Japan . |
| 2017370 | 10/1979 | United Kingdom . |
| 2117954 | 10/1983 | United Kingdom . |
| 2186412 | 8/1987 | United Kingdom . |

*Primary Examiner*—F. J. Bartuska
*Attorney, Agent, or Firm*—Lowe, Price, LeBlanc & Becker

[57] ABSTRACT

An exchange machine is provided with a bank note qualification detecting unit for detecting the qualification of a recovered bank note, a conveying unit for conveying the bank note to a stacking unit for recovery when the bank note qualification detecting unit determines that the bank note is damaged, and a conveying unit for conveying the bank note to a stacking unit for exchange when the bank note qualification detecting unit determines that the bank note is not damaged.

14 Claims, 16 Drawing Sheets

EXCHANGE MACHINE HAVING BANK NOTE QUALIFICATION DETERMINING CAPACITY

TECHNICAL FIELD

The present invention relates to an exchange machine which is disposed and is preferably used in a game parlor and in particular to an exchange machine which accepts bank notes recovered from game media lending machines disposed in a game parlor and enables the accepted bank notes to be used for exchange.

BACKGROUND TECHNOLOGY

A plurality of game machines and game media lending machines for lending game media used in the games are disposed in the game parlors. Specifically, the game machines and game media lending machines coexist and are grouped into rows of game machines.

Such rows of game machines are referred to as "game machine islands". The game media include, for example, metal balls, medals and the like.

These game machine islands are provided with bank note recovering machines for recovering bank notes which are inserted into game media lending machines in islands. The bank note recovering machines are adapted to accept the bank notes from each game media lending machine and to pass them to a common conveying line and finally to collect the bank notes at a given place in an island.

At least one exchange machine is disposed in each game machine island. The exchange machine is used to exchange bank notes or coins with bank notes which may be paid for lending of the game media in the above mentioned game media lending machine. In the exchange machine, the bank notes which are recovered by the bank note recovering machines are reused for exchange.

The bank notes which are recovered by the bank note recovering machine have heretofore been manually inserted into an exchange machine by clerks of the parlor. The bank notes inserted into the exchange machine are dispensed, when a player exchanges money, for being inserted into the game media lending machine. This causes the bank notes to be returned to the exchange machine. In other words, the bank notes are circulated between the game media lending machine and the exchange machines.

Repetition of such circulations causes the bank notes to be damaged, for example, wrinkled or partially torn. Damaged bank notes causes jamming of the bank notes in a circulation path. Accordingly, it is necessary to examine whether or not the bank note which is recovered by the bank note recovering machine is damaged.

Some of the bank notes are folded. Although folding per se is not damage to the bank note, it will be regarded as damage since it will cause jamming similarly to actual damage.

Such examination as to whether or not the bank notes are damaged has heretofore been made by clerks inspecting the condition of the bank notes one by one, for example, by sight or touch.

Accordingly, it takes an extended period of time and much labor to examine bank notes, and loading of qualified bank notes into an exchange machine one by one is troublesome work.

Since the damage conditions of the bank notes are determined manually, variations in examination results are liable to occur among individuals. Variations in determination will cause jamming to easily occur, or impair efficient circulation and use of the bank notes.

DISCLOSURE OF INVENTION

It is a first object of the present invention to provide an exchange machine in which bank notes are prevented from jamming due to damage thereof by automatically detecting the damaged bank note and removing it.

It is a second object of the present invention to provide a bank note conveying device which is capable of precisely performing orientation of posture and positioning of a bank note so that a damaged bank note can be properly detected.

It is a third object of the present invention to provide a bank note qualification identifying device which is capable of automatically detecting damage of bank notes without manual working in the exchange machine.

In order to accomplish the first object of the present invention, in a first aspect of the present invention, there is provided an exchange machine which uses externally accepted bank notes for exchange in which the machine comprises

- a bank note qualification identifying unit for determining the damaged condition of an accepted bank note;
- a stacking unit for exchange for accommodating bank notes for exchange;
- a conveying unit for exchange for conveying to the stacking unit for exchange bank notes which are determined as undamaged by the bank note qualification identifying unit; and
- an exchanging unit for accepting bank notes to be exchanged and for dispensing accommodated bank notes for exchange;

the bank note qualification identifying unit including

- a bank note qualification detecting unit which conveys bank notes for detecting whether light is transmitted through the conveyed bank notes in a plurality of positions in a width direction with respect to the conveying direction to output a detection signal; and
- a bank note qualification determining unit for determining the qualification of the bank note based upon the output signal from the bank note qualification detecting unit;

the bank note qualification detecting unit including a plurality of pairs of photosensors for detecting whether or not light is transmitted through the bank note, each pair comprising a light emitting element and a light receiving element, the bank note qualification determining unit including

- a qualified bank note counter which reads the output signals of the photosensors at intervals of a given period to increment the count when all pairs of photosensors output off-signals; and
- a length counter which reads the output signals from the photosensors at intervals of a given period to increment the count when any one of the pairs of photosensors outputs an off-signal; whereby reference values are compared with the increases in counts of the qualified bank note counter and the length counter before and after a bank note passes the qualification detecting unit for determining the qualification of the bank note.

The light emitting elements may be aligned in a width direction with respect to the bank note conveying direction and the light receiving elements may be aligned in such positions that they face the light emitting elements via at least a space where a bank note is located.

The exchanging unit may include an accepting unit for exchange for accepting bank notes to be exchanged; a bank note genuine or fake identifying unit for determining whether the bank note is genuine or fake; a conveying unit for identification for conveying bank notes from the accepting unit for exchange to the bank note genuine or fake identifying unit; a dispensing unit for exchange for dispensing exchanged bank notes; and a conveying unit for dispensing for conveying bank notes from the stacking unit for exchange to the dispensing unit for exchange when the bank note genuine or fake identifying unit determines that the accepted bank note is genuine.

An exchange machine may further include an accepting unit for recovery for accepting externally conveyed bank notes; and a bank note conveying device for conveying bank notes from the accepting unit for recovery to the bank note qualification identifying unit.

An exchange machine of the present invention may further include a bank note posture converting device disposed between the accepting unit for recovery and the bank note conveying device for converting the posture of the bank notes. The bank note posture converting device may include a bank note guide member which constitutes a bank note conveying path; and a bank note conveying member for conveying bank notes along the bank note guide member.

The bank note guide member may have along the bank note conveying path in succession an upstream unit for accepting bank notes, first and second conveying units for converting the posture of the conveyed bank notes and a downstream unit for discharging bank notes. The first converting unit may have a path which is curved with respect to the upstream unit at a given angle. The second converting unit may have a path which is spatially curved at a given angle with respect to the upstream unit and the first converting unit.

The bank note conveying member may include a first conveying member for conveying bank notes accepted in the accepting unit for recovery from the upstream unit to the first converting unit; a second conveying member provided along the first converting unit for conveying bank notes from the first to second converting units; a third conveying member provided along the second converting unit for conveying bank notes from the second converting unit to the downstream unit; and a fourth conveying member for conveying bank notes from the third conveying member to the downstream unit.

The bank note conveying device may include a conveying guide which constitutes the conveying path therein; a bank note guide for forming one side of the conveying path in a width direction; a pair of first sandwiching rollers which sandwich a paper therebetween to convey it downstream of the conveying path; a pair of second sandwiching rollers which are disposed in a position displaced in a width direction of the conveyed bank note and downstream of the first sandwiching rollers for further advancing the bank note by rotating with the bank note being sandwiched therebetween; and a biasing member provided between the first and second sandwiching rollers for attracting the bank note discharged from the first sandwiching roller to convey it to the second sandwiching rollers while displacing the bank note in a width direction.

The biasing member includes an endless belt; drive and driven pulleys rotatably mounted on the conveying guide between which the endless belt is tensioned; two rotors which are disposed in such a manner that they are capable of sandwiching a bank note between them and the conveying surface of the endless belt; and a rotor supporting member mounted on the conveying guide for rotatably supporting the two rotors. The drive and driven pulleys may have their axes of rotation biased with respect to the conveying path from the upstream to the downstream side and from the side of the bank note guide to the other side in a width direction thereof. The endless belt is disposed in such manner that the conveying surface is biased with respect to the conveying path from upstream to downstream side and from the other side to the side of the bank note guide in a width direction.

The spacing between the first and second sandwiching rollers is longer than the length of the bank note. The spacings between the upstream rotor of the biasing member and the first sandwiching rollers and between the downstream rotor and the second sandwiching rollers are shorter than the length of the bank note.

The rotors comprise either balls or rollers which rotatably support a bank note.

In order to accomplish the above mentioned second object of the present invention, in a second aspect of the present invention, there is provided a bank note conveying device for conveying bank notes on a downstream side along a conveying path by the rotation of a pair of first sandwiching roller with the bank note being sandwiched between the first sandwiching rollers and for conveying bank notes on the downstream side by the rotation of a pair of second sandwiching rollers with the bank note being sandwiched between the second sandwiching rollers, in which said device includes a conveying guide which constitutes the conveying path therein; and a bank note guide for forming one side of the conveying path in a width direction; and a biasing member provided between the first and second sandwiching rollers.

The biasing member includes drive and driven pulleys rotatably mounted on the conveying guide between which the endless belt is tensioned;

two rotors which are disposed in such a manner that they are capable of sandwiching a bank note between them and the conveying surface of the endless belt; and a rotor supporting member mounted on the conveying guide for rotatably supporting the two rotors.

The drive and driven pulleys have their axes of rotation biased with respect to the conveying path from the upstream to the downstream side and from the side of the bank note guide to the other side in a width direction thereof. The endless belt is disposed in such manner that the conveying surface is biased with respect to the conveying path from the upstream to the downstream side and from the other side to the side of the bank note guide in a width direction.

The spacing between the first and second sandwiching rollers is longer than the length of the bank note, and the spacings between the upstream rotor of the biasing member and the first sandwiching rollers and between the downstream rotor and the second sandwiching rollers are shorter than the length of the bank note.

The rotors may comprise either balls or rollers which rotatably support a bank note.

In a third aspect of the present invention to accomplish the above mentioned object, there is provided a bank note qualification identifying device for determining the damaged condition of an accepted bank note comprising a bank note qualification detecting unit which conveys bank notes for detecting whether light is transmitted through the conveyed bank notes in a plurality of positions in a width direction with respect to the conveying direction to output a detection signal; and a bank note qualification determining unit for determining qualification of the bank note based upon the output signal from the bank note qualification detecting unit;

the bank note qualification detecting unit including a plurality of pairs of photosensors for detecting whether or not light is transmitted through the bank note, each pair comprising a light emitting element and a light receiving element, the bank note qualification determining unit including a qualified bank note counter which reads the output signals of the photosensors at intervals of a given period to increment the count when all pairs of photosensors output off-signals; and a length counter which reads the output signals from the photosensors at intervals of a given period to increment the count when any one of the pairs of photosensors outputs an off-signal; whereby reference values are compared with the increases in counts of the qualified bank note counter and the length counter before and after a bank note passes the qualification detecting unit for determining the qualification of the bank note.

The light emitting elements may be aligned in a width direction with respect to the bank note conveying direction and the light receiving elements may be aligned in such positions that they face to the light emitting elements via at least a space where a bank note is located.

A bank note qualification detecting unit may include a printed board for light emitting elements of the photosensors; and a printed board for light receiving elements of the photosensors.

The light emitting elements of a plurality of pairs of photosensors are mounted on the printed board for the light emitting elements; and the light receiving elements of a plurality of pairs of photosensors are mounted on the printed board for the light receiving elements.

When a bank note is inserted into the exchange machine, the damaged condition of the bank note is firstly determined in the bank note identifying unit. When it is determined that the accepted bank note is not damaged, the bank note is conveyed to the stacking unit for exchange by the conveying unit for exchange. Accordingly, only the bank notes which are determined as not damaged will be used for exchange.

When the bank note is determined as damaged, it is conveyed from the bank note qualification detecting unit to the stacking unit recovery, for example, by the conveying unit for recovery. The bank notes in the stacking unit for recovery will not circulate through the game machine island, so trouble due to damaged bank notes can be prevented.

If the exchange machine includes a bank note posture converting device, the first conveying member conveys bank notes accepted in the upstream unit to the first converting unit which is spatially at a given angle with respect to the upstream unit. While the bank notes are conveyed from the upstream unit to the first converting unit along the curved path of the first converting unit, they are advanced in a direction which is at a given angle with respect to the conveying direction in the upstream unit while being curved at the given angle along the corner.

The second conveying member conveys the bank notes in the first converting unit to the downstream second converting unit. The second converting unit is twisted at a given angle with respect to the upstream and the first converting unit so that the bank notes are turned by 90 degrees along the corner of the second converting unit while they are conveyed from the first converting unit to the second converting unit. The third conveying member conveys bank notes in the second converting unit to the downstream unit.

The fourth conveying member conveys the bank notes in the second converting unit to the downstream unit which is spatially at a given angle with respect to the second converting unit. While the bank notes are conveyed from the second converting unit to the downstream unit, they are turned at a given angle and are advanced in a direction which is a given angle with respect to the conveying direction of the second converting unit and then discharged from the discharge slot. This causes the bank notes to be turned so that the lateral sides thereof are changed to the front and rear sides and to be conveyed from the downstream unit.

If the bank note conveying device includes the biasing member, etc. a bank note is sandwiched between a pair of the first sandwiching rollers on the conveying path within the conveying guide and is moved downstream of the conveying path by the rotation of the first sandwiching rollers. The bank note is then sandwiched between the conveying surface of the endless belt of the biasing member and the upstream rotors and is moved with the movement of the endless belt.

The drive and driven pulleys between which the endless belt is tensioned are rotated with their axes of rotation being biased with respect to the conveying path from the upstream to the downstream and from the side of the bank note guide to the other side in a width direction thereof. The endless belt is moved with its conveying surface being biased with respect to the conveying path from the upstream to the downstream side and from the other side to the side of the bank note guide in a width direction.

Therefore, when the bank note is disengaged from the first sandwiching roller at the rear end thereof, it is moved toward the bank note guide together with the endless belt. When the bank note hits upon the bank note guide at the front end of the upper portion thereof, it turns in the moving direction along the guide and advances along the conveying path.

At this time, the bank note is supported on two points by two rotors on the side opposite to the endless belt. Each rotor rotates and support the bank note so that it is rotatable in any direction. Therefore, they are capable of changing the moving direction of the bank note and thus correcting the inclination of the bank note.

The bank note is advanced along the bank note guide without changing it orientation or posture. When the leading edge of the bank note reaches the pair of second sandwiching rollers, it is sandwiched between the second sandwiching rollers and is advanced in a conveying direction with the rotation of the second sandwiching rollers.

The rotors comprise balls or rollers and are capable of rotatably supporting the bank note.

The light emitting elements of the plurality of pairs of photosensors emit lights from one inner side of the conveying guide to the corresponding light receiving elements on the opposite inner side of the guide and the light receiving element receive the light. When the conveyed bank note passes through the conveying path within the guide it interrupts the light from each light emitting element of the photosensors. When the bank note has passed, each light receiving element again receives light from the corresponding light emitting element.

The plurality of pairs of photosensors are aligned in a width direction with respect to the bank note conveying direction. If the light from the light emitting elements of the photosensors are simultaneously interrupted when the bank note passes through the conveying path within the conveying guide and the light receiving elements simultaneously receive light from the light emitting elements. It can be determined that the bank note is not torn or folded and thus qualified since the plurality of photosensors are aligned in a width direction with respect to the bank note conveying direction.

On the other hand, if only some of the lights from the light emitting elements is interrupted and some of the light receiving elements receive light, from when the bank note enters the conveying path in the conveying guide and until it has passed the conveying path, it can be determined that the bank note is damaged or folded at the position where the light receiving elements receives light.

If the printed boards for the light emitting and receiving elements are provided, the light emitting and receiving elements of the pair of photosensors are mounted on the printed boards, respectively. Thus the photosensors can be mounted by simply mounting the printed boards on the outer sides of the conveying guides. Assembly is therefore easy.

If the bank note qualification determining unit includes the qualified bank note counter, the length counter and the determining processing unit, the qualified bank note counter periodically increments its counter at intervals of a given period when the light to all of the photosensors is interrupted. An increase in the value of the qualified bank note counter before and after the bank note passes the bank note qualification detecting unit is that number of positions where there is no abnormality such as a tear of the bank note, among the plural positions in the longitudinal direction of the bank note corresponding to the given period.

On the other hand, the length counter periodically increments its count at intervals of a given period when any one of the plurality of pairs of photosensors is interrupted. An increase in count of the length counter before and after the bank note passes the bank note qualification detecting unit is representative of the full length of the bank note in a conveying direction of the bank note. Accordingly, determination which is made based upon the increase in counts of these counters has high precision based on the detected values quantitatively representative of the abnormality of the bank note. If the bank note is slightly folded or torn in the plural positions, the increase in the count of the genuine counter becomes less than that of the normal case depending upon the damage condition of whole bank note. If two superposed bank notes are conveyed or one bank note is conveyed under an inclined condition, the increase in the counter value becomes higher than that of the normal case.

In accordance with the exchange machine, determination as to whether the bank note which is recovered from the game media lending machine is damaged or not is automatically made. Only qualified bank notes are selected and automatically conveyed to the stacking unit for exchange, where they are used for exchange. Accordingly, troublesome manual working such as sorting the recovered bank notes and loading them into the exchange machine is eliminated. Saving in man power is achieved. Since determination is mechanically made, there are no variations in determination criteria. Jamming due to damage of the bank notes can be positively prevented, and usable bank notes are advantageously recirculated.

If the coin accepting unit for accepting coins from the coin conveying machine is proviced, players can receive exchanged coins from the coin dispensing unit.

If the bank note posture converting device is provided, the bank note is turned along the second converting unit so that the lateral sides of the bank note are changed to leading and trailing sides thereof. The posture of the bank notes can be converted in a shorter conveying range. The facility is smaller and handling is convenient. A large installation area is not necessary, so effective utilization of the space can be achieved.

If the bank note conveying device includes the biasing member etc., the endless belt has a conveying surface which is biased with respect to the conveying path toward the conveying guide from the upstream side to the downstream side and the bank note is supported by the endless belt and two rotatable rotors on respective points. Accordingly, the advancing direction of the bank note can be easily turned along the bank note guide for correcting the inclination of the bank note. Damage to the bank note due to catching on the conveying path can be prevented. The bank notes can be smoothly conveyed without causing any jamming due to catch of the bank note.

If the rotors comprise balls or rollers, they rotatably support the bank notes. Accordingly, the bank notes can be smoothly conveyed.

BEST MODE FOR EMBODYING THE INVENTION

Now, an embodiment of the present invention will be described with reference to the drawings.

Each drawing shows an embodiment of the present invention.

Figure 2:
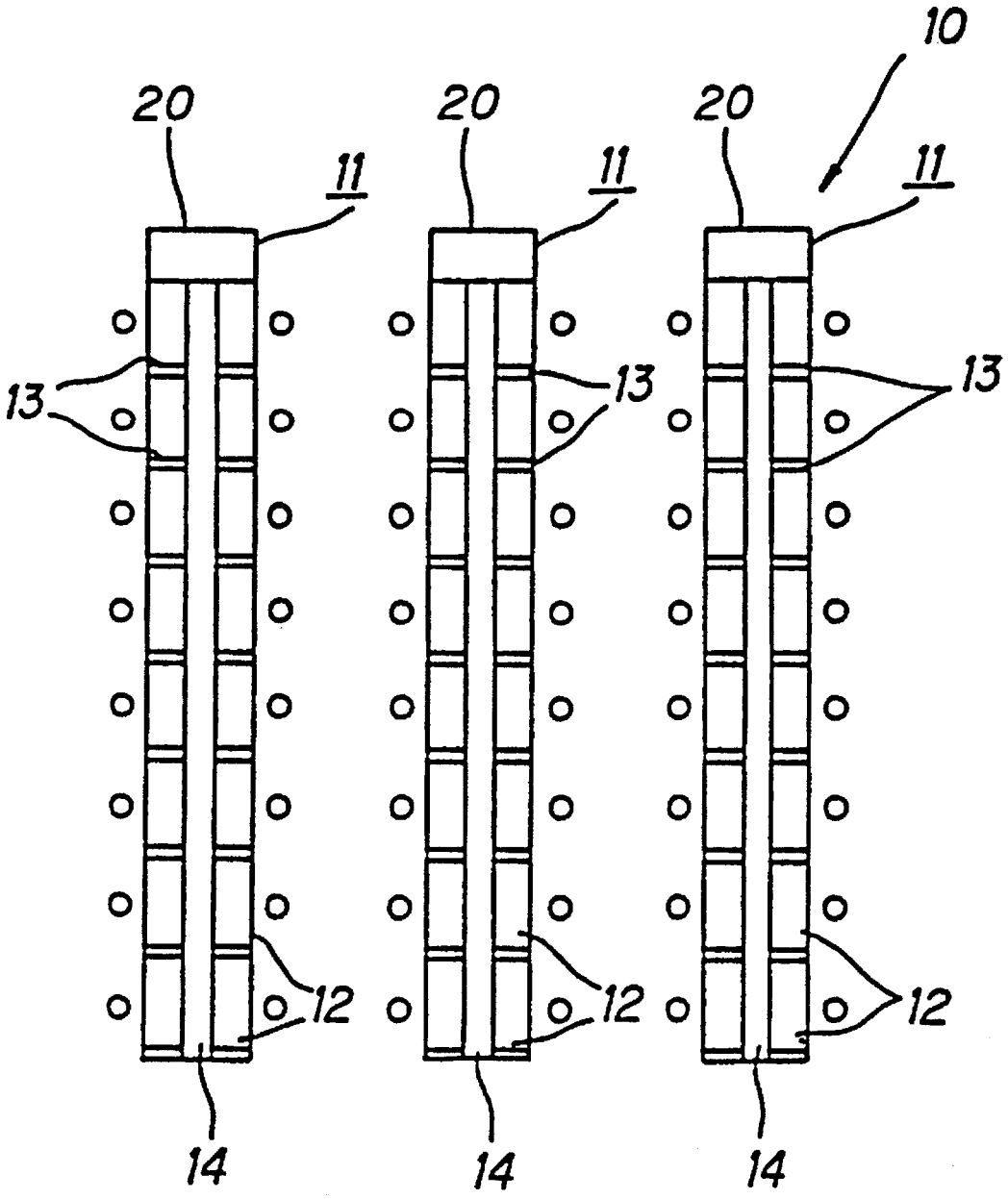
FIG. 2 is a plan view showing the arrangement of exchange machines in a game parlor.

As shown in FIG. 2, three "islands" or rows of game machines 11 are disposed in a game parlor 10. Each island 11 includes a plurality of game machines 12 on both sides thereof. Each game machine 12 includes, for example, a slot machine. Game media lending machines 13 are disposed between adjacent game machines 12. The game media lending machines 13 are adapted to lend game media in response to insertion of a bill or a bank note M (for example, a 1000 yen bank note) having a given value. Bill exchange machines 20 are disposed at opposite ends of each island of the game machines 11.

Bank note conveying machines and coin conveying machines (not shown) are provided on a central path 14 within the game machine islands 11. The bank note conveying machines are adapted to collect bank notes from the game media lending machines 13 in the game machine islands 11 and to convey them to the bill exchange machines 20. The coin conveying machines are adapted to collect coins from the game media lending machine 13 and to convey them to the exchange machines 20.

Figure 1:
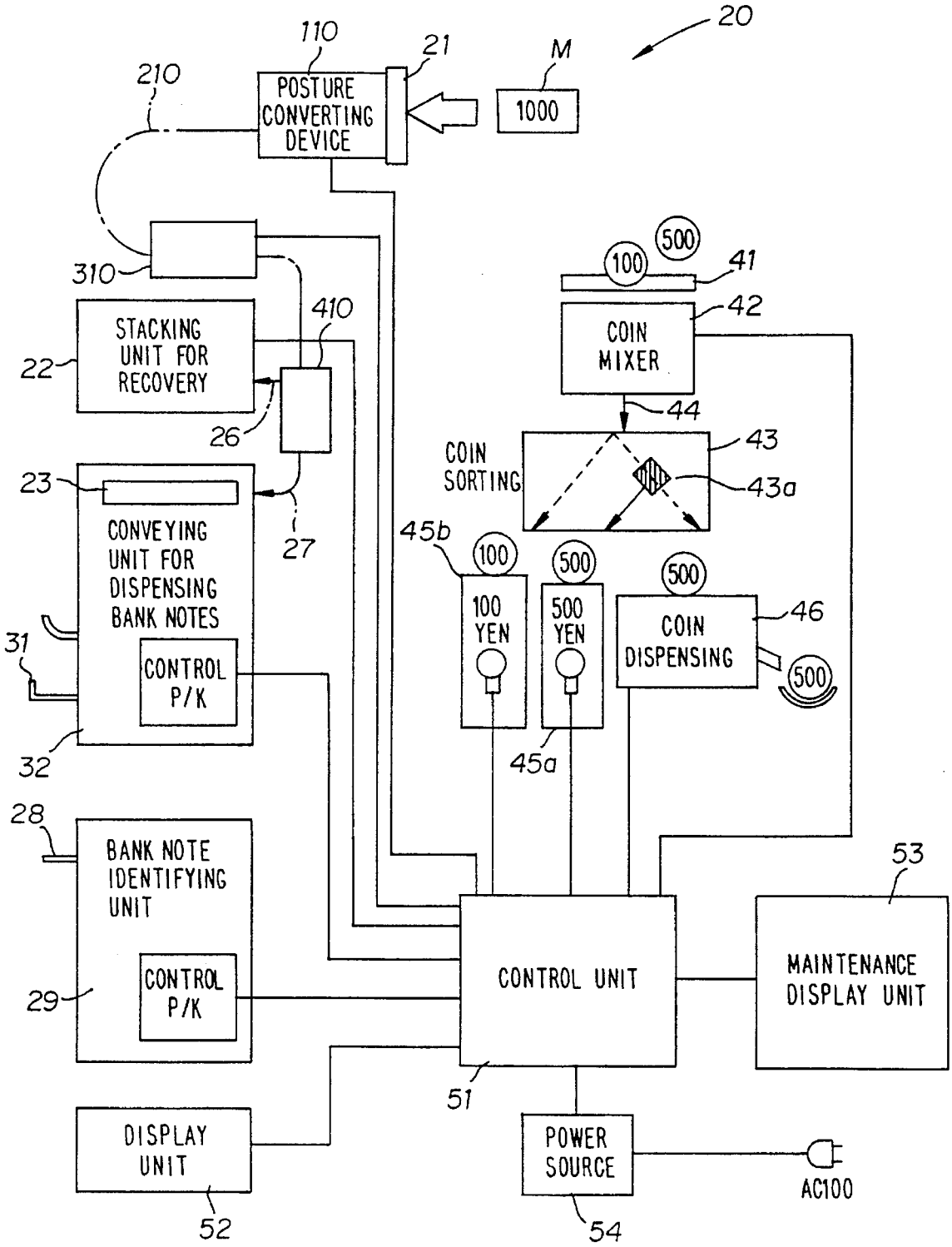
FIG. 1 is a schematic block diagram showing an embodiment of an exchange machine of the present invention.
Figure 16:
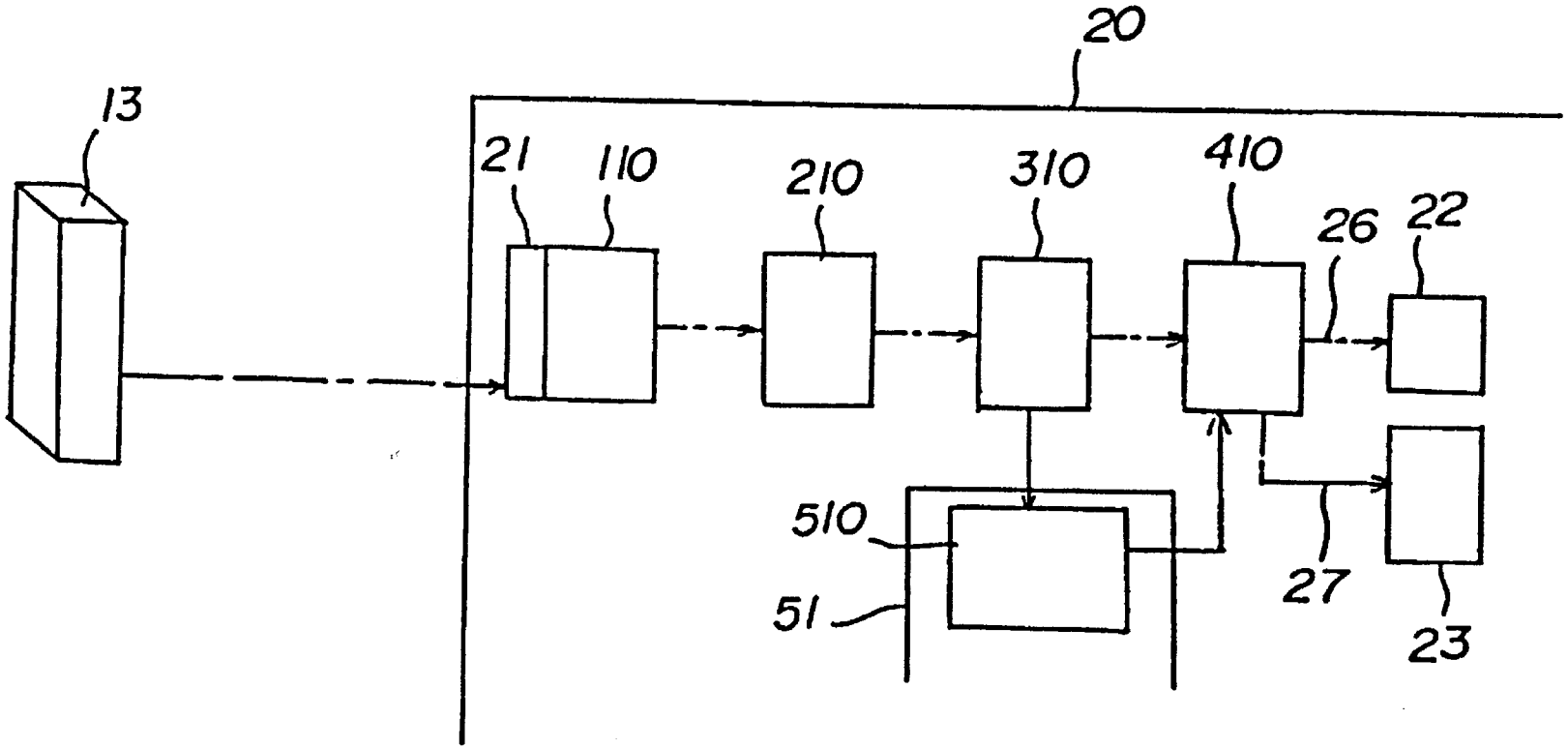
FIG. 16 is a block diagram showing a part of the exchange machine in the embodiment of the present invention.

The exchange machines 20 accept bank notes and coins which are recovered by the bank note and coin conveying machines and use them for money exchange. As shown in FIGS. 1 and 16, each exchange machine 20 comprises an accepting unit for recovery 21, a bank note posture converting device 110, a bank note stacking unit for recovery 22, a bank note stacking unit for exchange 23, a bank note qualification detecting unit 310, a bank note conveying device 210, a conveying unit for recovery 26, a conveying unit for exchange 27, a conveying path switching unit 410, a bank note accepting unit for exchange 28, a bank note identifying unit 29, a conveying unit for identification (not shown), a bank note dispensing unit for exchange 31, a conveying unit for bank note dispensing 32, a coin accepting unit 41, a coin mixer 42, a sorting unit 43, a conveying unit for sorting 44, coin stacking units 45*a*, 45*b*, a coin dispensing unit 46, a control unit 51, a display unit 52, a maintenance display unit 53 and a power source 54 therefor.

Figure 17:
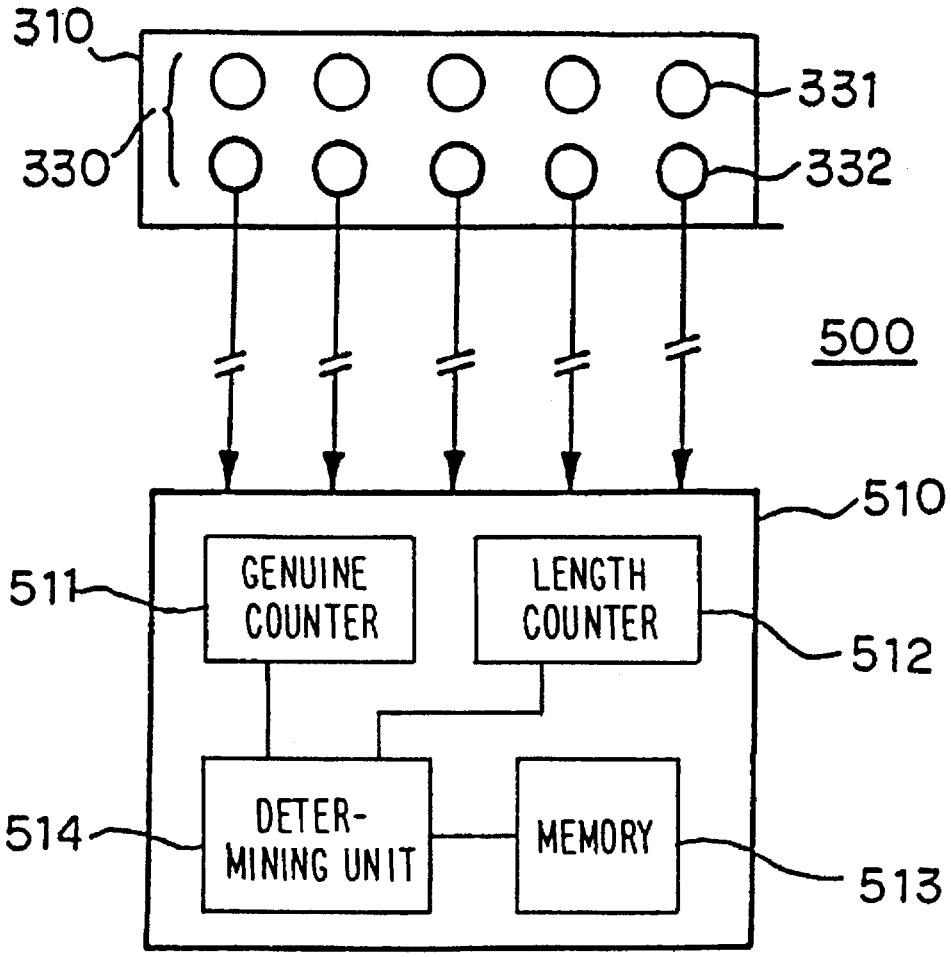
FIG. 17 is a block diagram showing a structure of the bank note qualification identifying unit.

The control unit 51 is adapted to control the exchange machine 20 and specifically to control the bank note posture converting device 110, a stacking unit for recovery 22, the stacking unit for exchange 23, the bank note qualification detecting device 310, the conveying path switching unit 410, the bank note identifying unit 29, the coin mixer 42, the sorting unit 43, the coin stacking units 45*a*, 45*b*, the display unit 52 and the maintenance display unit 53. The control unit 51 includes a bank note qualification determining unit 510 (shown in FIG. 16) as its inner function unit. The bank note qualification determining unit 510 and the bank note qualification detecting unit 310 constitutes a bank note qualification identifying unit 500 which is shown in FIG. 17.

The accepting unit for recovery 21 includes an accepting slot into which the bank notes conveyed from the bank note conveying machine are recovered. The bank note conveying device 210 comprises a belt and rollers for conveying bank notes from the accepting unit for recovery 21 to the bank note qualification detecting unit 310 via the bank note posture converting device 110. The bank note conveying device 210 has a function to correct the position of the bank note on the conveying path in a width direction or the inclination thereof. The bank note posture converting device 110 and the bank note conveying device 210 will be described hereafter in detail.

The conveying unit for recovery 26 has a belt and rollers for conveying the bank notes from the bank note qualification detecting unit 310 to the stacking unit for recovery 22 when the bank note qualification detecting unit 310 determines that the accepted bank note is damaged. The conveying unit for exchange 27 comprises a belt and rollers for conveying bank notes from the bank note qualification detecting unit 310 to the stacking unit for exchange 23 when the bank note qualification detecting unit 310 determines that the bank note is not damaged.

The bank note qualification determining unit 510 determines the qualification of the bank note based upon an output signal from the bank note qualification detecting unit 310 to control the conveying path switching unit 410 for switching between the conveying unit for recovery 26 and the conveying unit for exchange 27. The bank note qualification detecting unit 310 will be described hereafter in detail.

The bank note identifying unit 29 identifies whether the bank note for exchange such as 10000 yen bank note is genuine or fake and how much the amount thereof is. The conveying unit for identification includes a belt and rollers and is adapted to convey bank notes from the accepting unit for exchange 28 to the bank note identifying unit 29. When the bank note identifying unit 29 determines that the accepted bank note is genuine, the conveying unit 32 conveys the bank note from the stacking unit for exchange 23 to the dispensing unit for exchange 31. When a coin selecting button (not shown) is depressed, the conveying unit 32 for dispensing conveys coins from the coin stacking units 45*a*, 45*b* to the coin dispensing unit 46 in lieu of dispensing bank notes.

The coin accepting unit 41 includes an accepting slot for recovering coins conveyed from the coin conveying machine. The conveying unit for sorting 44 conveys coins from the coin accepting unit 41 to the sorting unit 43. The sorting unit 43 sorts the coins into 100 yen coins and 500 yen coins depending upon their denomination. The coin stacking units 45*a*, 45*b* store coins which have been sorted by the sorting unit 43 for exchange.

Now, the bank note posture converting device 110 will be described in detail.

Figure 3:
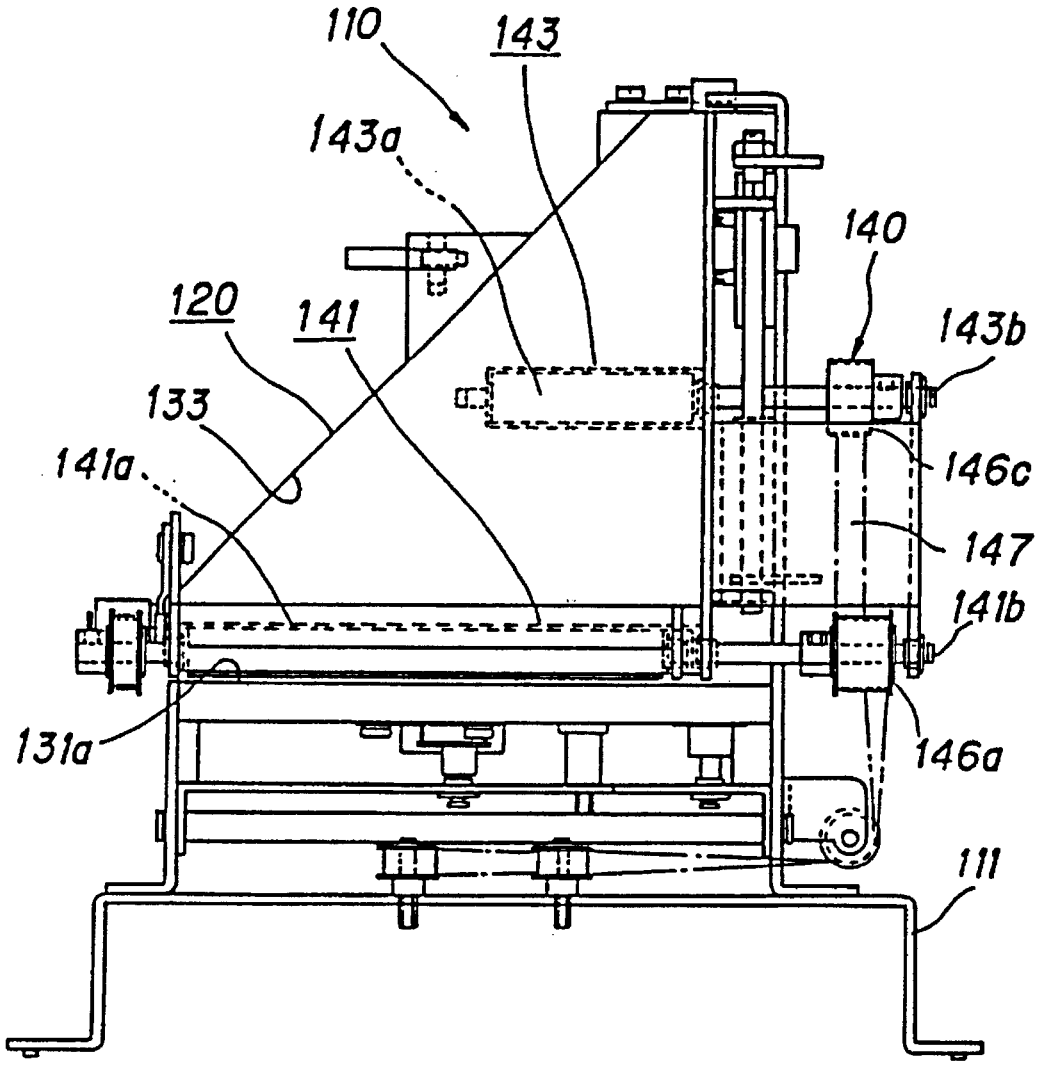
FIG. 3 is a front view showing a bank note posture converting device in the embodiment of the exchange machine.

As shown in FIG. 3, the bank note posture converting device 110 comprises a bank note guide member 120 and a bank note conveying member 140. The bank note guide member 120 is secured to a base portion 111.

The bank note guide member 120 forms a bank note conveying path 21 along an inner guide surface 130. The bank note conveying path 121 has a width through which one bank note can be passed. The guide surface 130 has an upstream unit 131, a first conversion unit 132, a second conversion unit 133 and a downstream unit 134. The upstream unit 131 is continued to the accepting slot 131*a* and is planer in shape so that the bank note accepted into the accepting slot 131*a* is guided therealong. The accepting slot is wide so that it is easy to accept the bank note.

Figure 4:
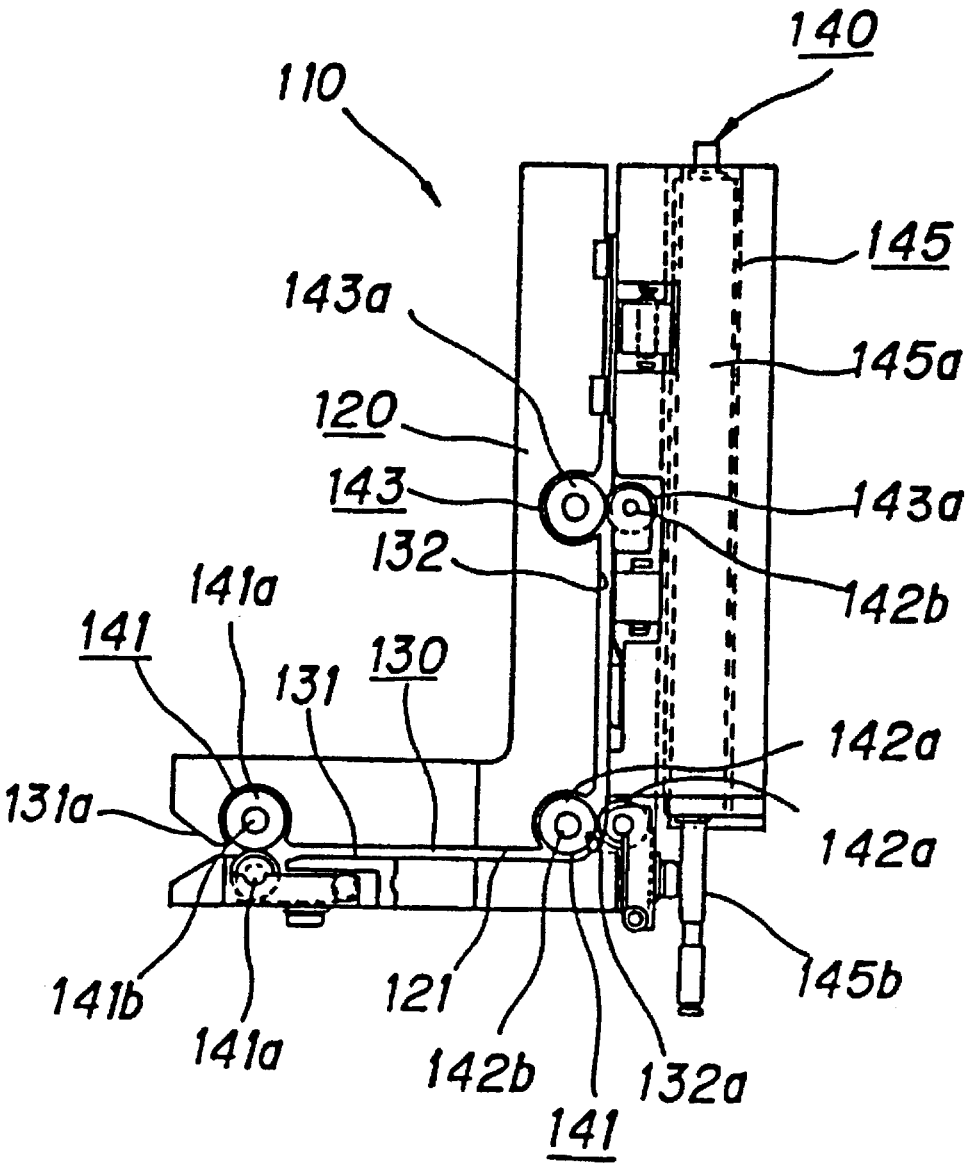
FIG. 4 is a right elevational view showing a bank note posture converting device in the embodiment of the exchange machine.

As shown in FIG. 4, the first converting unit 132 is disposed downstream of the upstream unit 131 and is curved so that it is normal to the upstream unit 131. The second converting unit 133 is disposed downstream of the first converting unit 132 and is curved so that it is normal to the upstream unit 131 and the first converting unit 132.

The downstream portion 134 is disposed downstream of the second converting unit 133 and is continued to a discharge slot 134*a* and is curved so that it is normal to the second converting unit 133. The downstream portion 134 extends in a direction opposite to the upstream portion 131. The downstream portion 134 is planer in shape and discharges the bank note from the discharge slot 134*a*.

The bank note conveying member 140 has first, second, third and fourth conveying members 141, 143, 144 and 145, which have pairs of rollers 141*a* to 145*a*, respectively. The pairs of rollers 141*a* to 145*a* have rotary shafts 141*b* to 145*b* which are disposed normal to the conveying direction and are provided along the respective guide surfaces 131, 132, 133, 134.

Figure 6A:
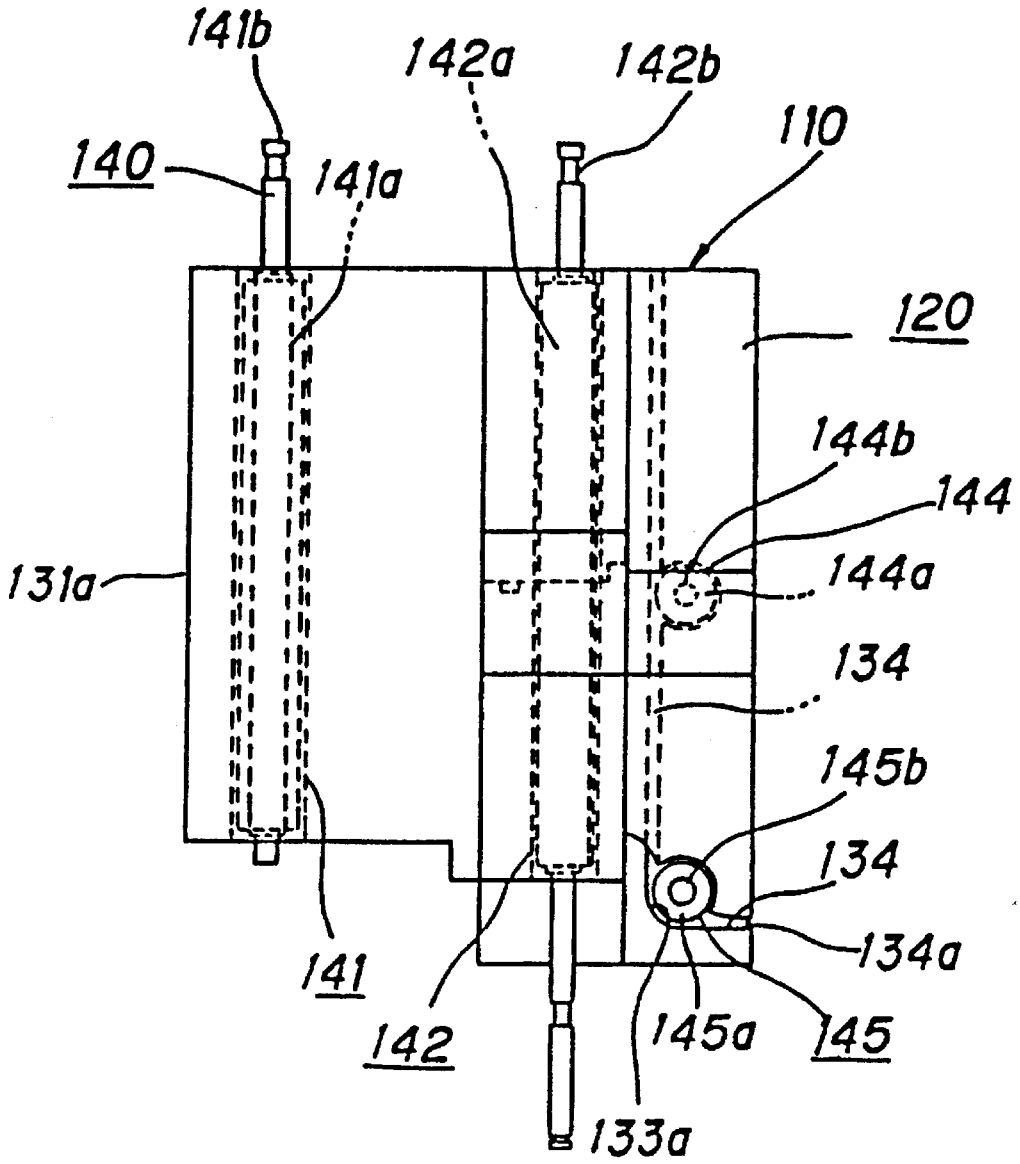
FIG. 6A is a plan view showing a bank note posture converting device in the embodiment of the exchange machine.
Figures 6B, 6C, 6D, 6E:
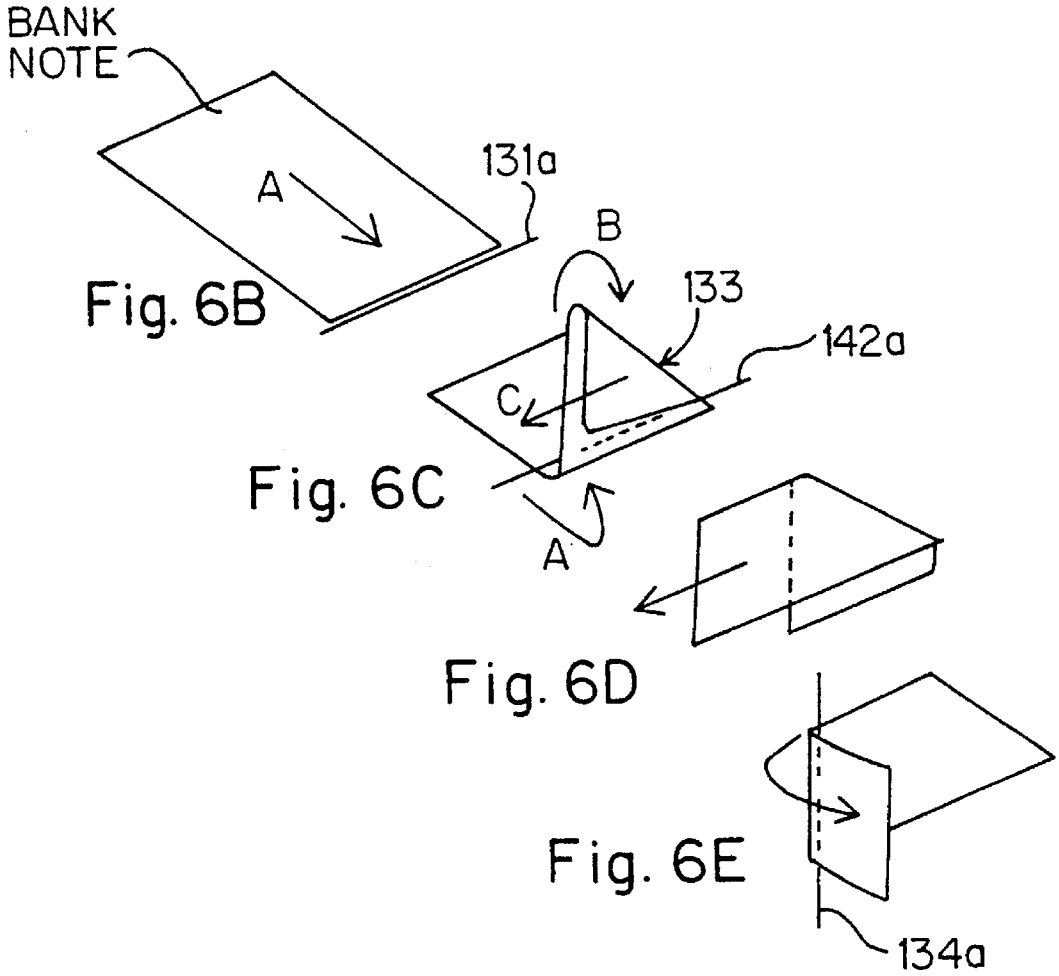
FIG. 6B-6E illustrates a bank note passing through a bank note posture converting device in the embodiment of the exchange machine.

As shown in FIG. 6, the rollers 141*a* to 143*a* of the first and second conveying members 141 and 143 extend perpendicularly to the rollers 144*a*, 145*a* of the third and fourth conveying members 144 and 145. Pulleys 146*a* to 146*c* are secured to rotary shafts 141*b* to 143*b* of the rollers 141*a* to 143*a*. An endless belt 147 is wound on the pulleys 146*a* to 146*c*.

Pulleys 148*a* and 148*b* are secured to the rotary shafts 144*b* to 145*b* of the rollers 144*a* to 145*a*. An endless belt 149 is wound on the pulleys 148*a* and 148*b*. The pulleys are linked with a drive apparatus so that the rollers 141*a* to 145*a* are rotated at the same speed.

As shown in FIG. 4, the first conveying member 141 includes two pairs of rollers 141*a* and 142*a* which are provided at the accepting slot 131*a* and a corner 132*a* between the upstream portion 131 and the first converting unit 132, respectively and extend in a direction perpendicular to the direction of conveying of the bank note. In such a manner, the first conveying member 141 is provided along the upstream portion 131 for conveying bank notes from the accepting slot 131*a* to the first converting unit 132 through the upstream portion 131.

As shown in FIG. 3, the second conveying member 143 has a pair of rollers 143*a* about half the length of the rollers 141*a*, 142*a*, and which are disposed in the vicinity of substantially the center of the first converting unit 132 and extend perpendicularly to the conveying directing of the bank notes in the first converting unit 132. In such a manner, the second conveying member 143 is provided along the first converting unit 132 for conveying the bank notes from the first converting unit 132 to the second converting unit 133.

Figure 5:
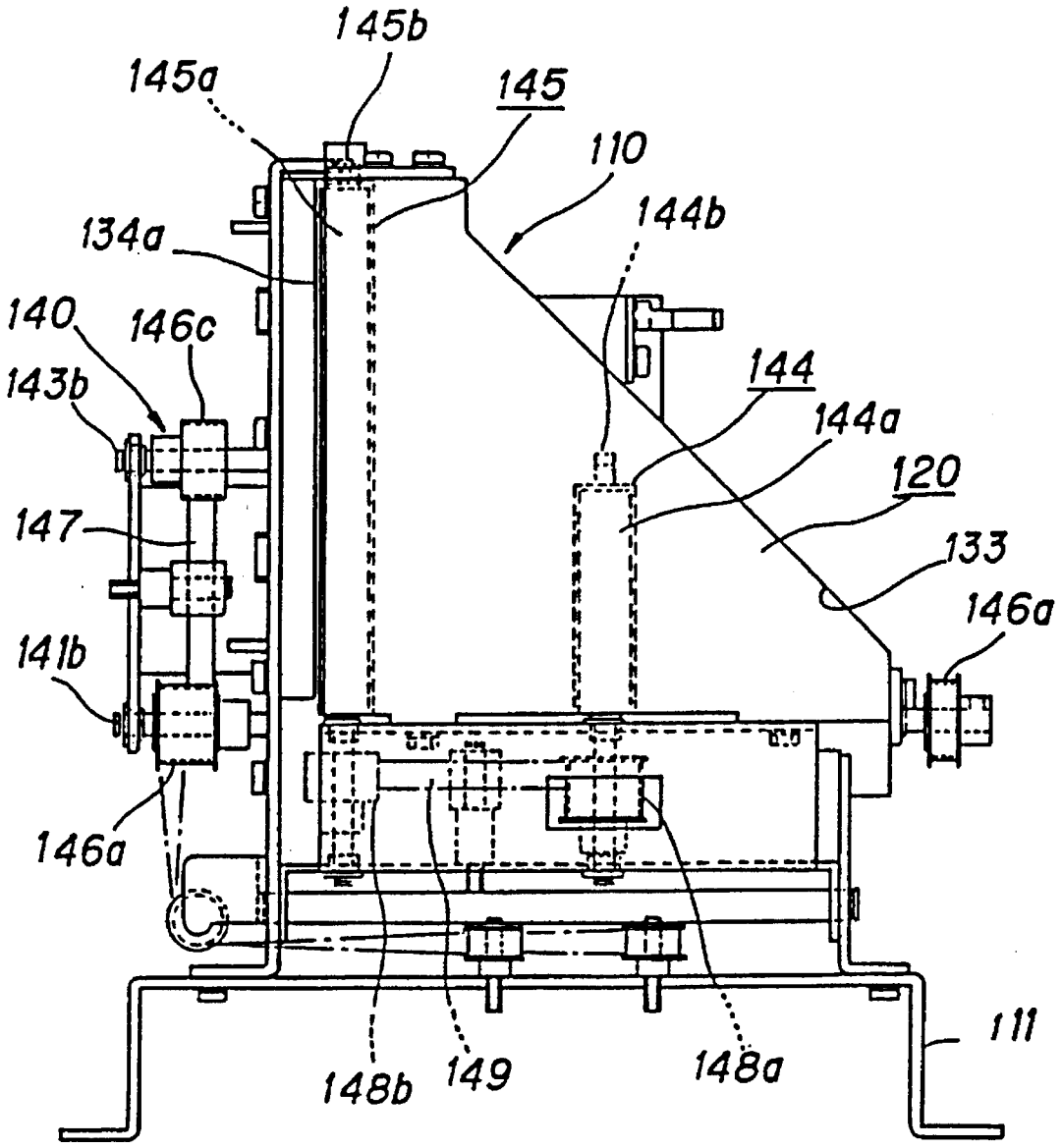
FIG. 5 is a rear view showing a bank note posture converting device in the embodiment of the exchange machine.

As shown in FIG. 5, the third conveying member 144 includes a roller 144*a* having a length which is substantially equal to the length of the rollers 143*a*. The roller 144*a* is disposed in the vicinity of the center of the second converting unit 133 and extends in a direction perpendicular to the conveying directing of the bank note in the second converting unit 133. In such a manner, the third conveying member 144 is provided along the second converting unit 133 for conveying the bank notes from the second converting unit 133 to the downstream portion 134.

As shown in FIG. 5, the fourth conveying member 145 includes a roller 145*a* having a length which is substantially equal to the length of the rollers 141*a*, 142*a*. The roller 145*a* is disposed at the corner 133*a* between the second converting unit 133 and the downstream portion 134, and extends in a direction perpendicular to the conveying direction of the bank note in the downstream portion 134. In such a manner, the fourth conveying member 145 is provided along the downstream portion 134 for conveying the bank notes from the second converting unit 133 to the discharge slot 134*a*.

Now, the bank note conveying device 210 will be described in detail.

Figure 7:
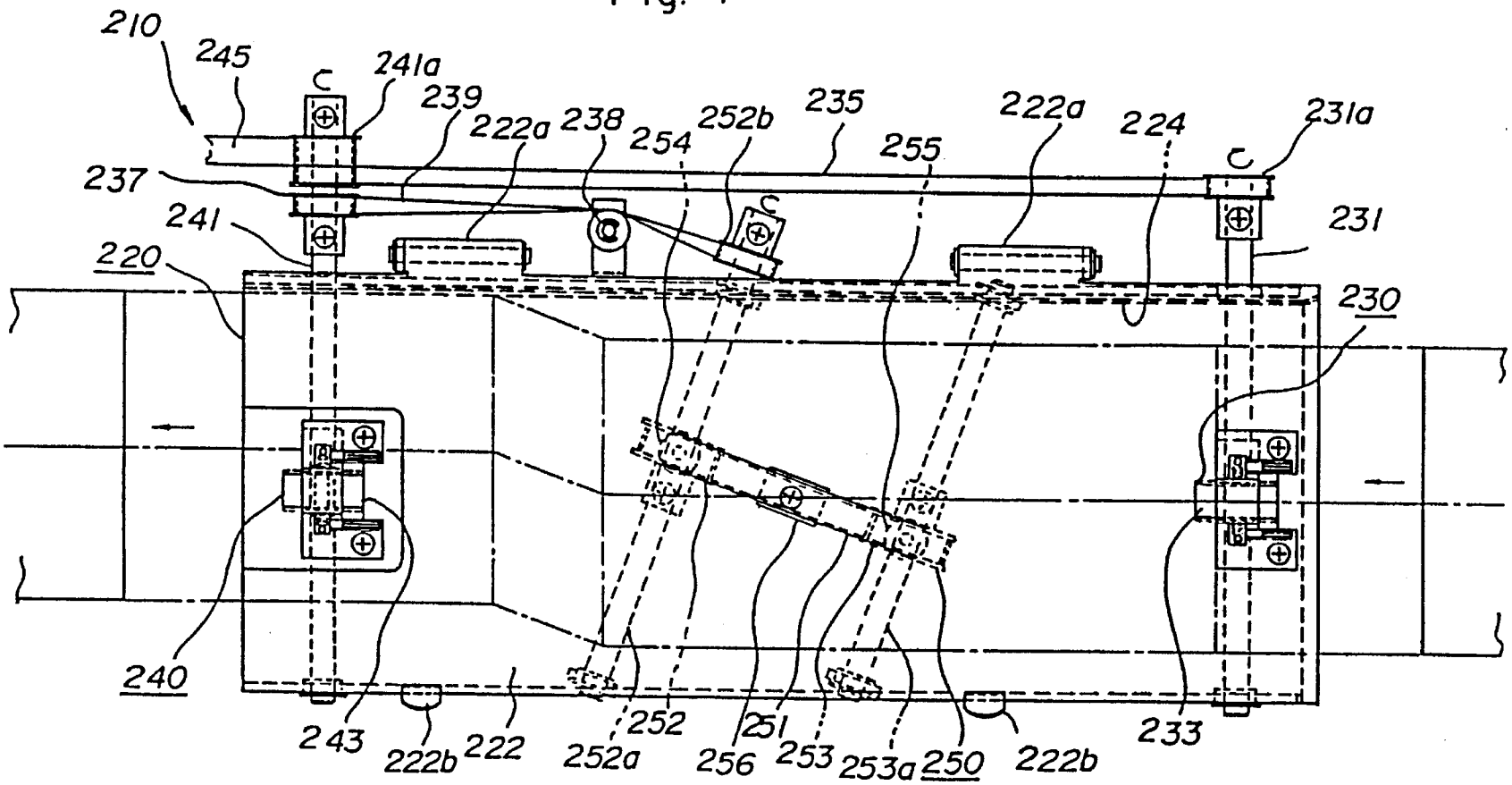
FIG. 7 is a front view showing a bank note conveying device in the embodiment of the exchange machine of the present invention.
Figure 8:
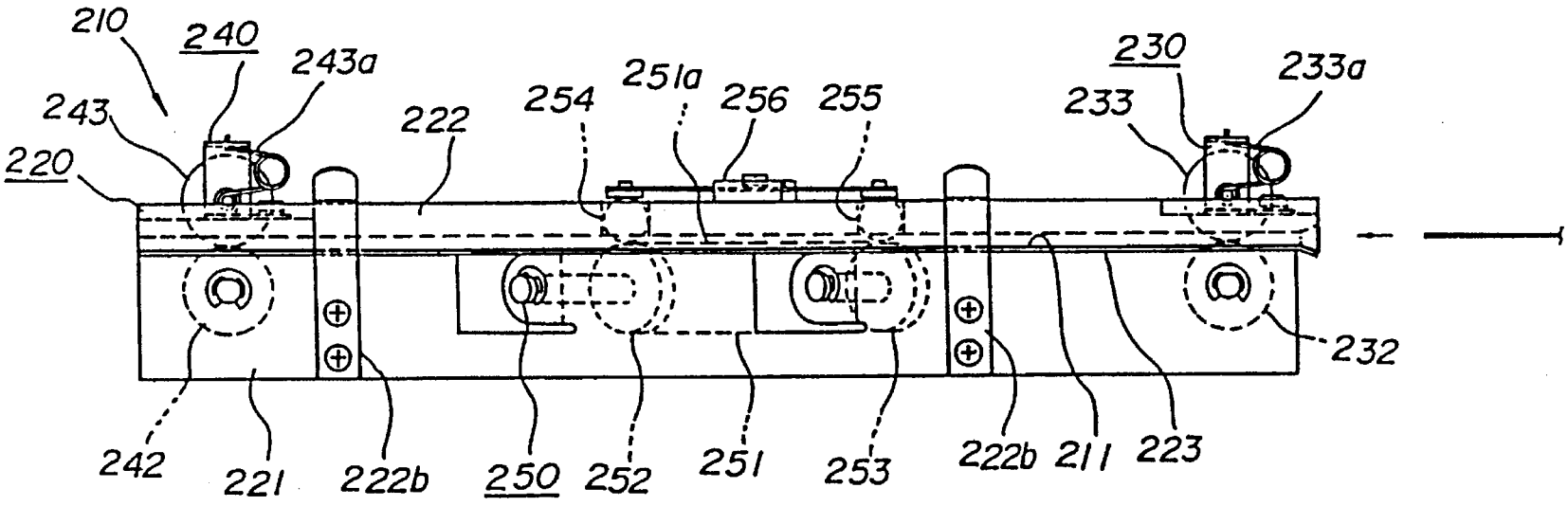
FIG. 8 is a bottom view showing a bank note conveying device in the embodiment of the exchange machine of the present invention.
Figure 9:
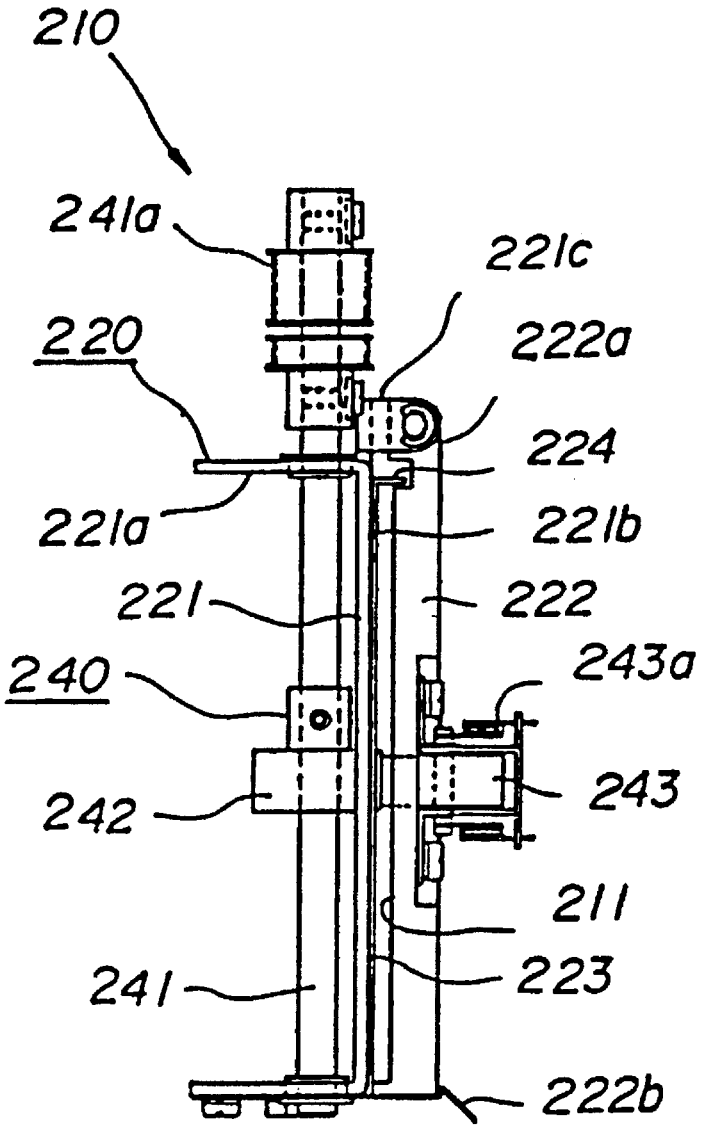
FIG. 9 is a left elevational view showing a bank note conveying device in the embodiment of the exchange machine of the present invention.

The bank note conveying device 210 is provided within an exchange machine (not shown) for conveying bank notes such as 1000 yen or 10000 yen bank notes. As shown in FIGS. 7 to 9, the bank note conveying device 210 includes a conveying guide 220, a pair of first sandwiching rollers 230, a pair of second sandwiching rollers 240 and a biasing member 250.

The conveying guide 220 includes a supporting plate 221, an upper guide 222, and a lower guide 223. The supporting plate 221 extends in a conveying direction and has sides 221*a* which are normally bent in a rearward direction. In FIG. 7, the conveying direction is such that the right and left sides of the drawing are upstream and downstream sides, respectively. The lower guide 223 is mounted on the front side 221*b* of the supporting plate 221. As shown in FIG. 9, the lower guide 223 is bent in a forward direction on one side thereof to form a bank note guide 224.

The upper guide 222 covers the lower guide 223 on the front side thereof and has a projected end 222*a* which is secured to a projection portion 221*c* of the supporting plate 221 on one side thereof in two positions by means of a pin and is bolted to the supporting member 221 through a guide lock lever 222*b* on the other side thereof in two positions. As shown in FIG. 8, the conveying guide 220 forms a conveying path 221 between the inner upper guide 222 and the lower guide 223. The bank note guide 224 forms one side of the conveying path 211 in a width direction.

The first sandwiching roller 230 includes a rotary shaft 231, a drive roller 232 which is mounted on the rotary shaft 231 and a driven roller 233 which is rotated by frictional transmission. The second sandwiching roller 240 includes a rotary shaft 241, a drive roller 242 mounted on the rotary shaft 241 and a driven roller 243 which is rotated by frictional drive transmission from the drive roller 242.

The rotary shafts 231 and 241 extend in a direction perpendicular to a conveying direction in which the conveying guide 220 extends. The rotary shaft 231 and 241 are rotatably mounted on the supporting plate 221 so that they extend through the opposite sides 221*a* of the supporting plate 221. The drive rollers 232 and 242 extend into the conveying path 211 through holes formed in the supporting plate 221 and the lower guide 223 while the driven rollers 233 and 243 extend into the conveying path 211 through the holes formed in the upper guide 222. The driven roller 233 is biased toward the drive roller 232 by the spring 233*a* and its rotary shaft is rotatably mounted on the upper guide 222. Similarly to the drive roller 233, the driven roller 243 is biased toward the drive roller 242 by a spring 243*a* and its rotary shaft is rotatably mounted on the upper guide 222.

The spacing between the first and second sandwiching rollers 230 and 240 is made longer than the length of a bank note. Pulleys 231*a* and 241*a* are mounted on one end of the rotary shafts 231 and 241. An endless belt 235 is tensioned between the pulleys 231*a* and 241*a*. A drive belt 245 is tensioned between the pulley 241*a* and a drive shaft (not shown) of a prime mover.

Drive of the prime mover causes the first and second sandwiching rollers 230 and 240 to rotate at the same speed and the bank note is sandwiched between the drive roller 232 and the driven roller 233 for moving the bank note in a downstream direction of the conveying path 211 by the rotation of the first sandwiching roller 230. The bank note is then sandwiched between the drive roller 242 and the driven roller 243 for advancing the bank note by the rotation of the second sandwiching roller 240.

The biasing member 250 is provided in the vicinity of the center of the conveying path 211 in a width direction between the first and second sandwiching members 230 and 240. The biasing member 250 includes an endless belt 251, a drive pulley 252 and a driven pulley 253, rotors 254 and 255 each comprising a steel ball and a rotor supporting member 256.

The drive pulley 252 and driven pulley 253 have their rotary shafts 252*a* and 253*a* rotatably mounted on the side 221*a* of the supporting plate 221. The rotary shafts 252*a* and 253*a* have axes of rotation which are biased with respect to the conveying path 211 from the upstream to the downstream side and from the bank note guide side to the other side in a width direction. The drive pulley 252 is closer to the bank note guide 224 than the driven pulley 253. The drive pulley 252 and the driven pulley 253 extend into the conveying path 221 through holes formed in the supporting plate 221. A pulley 252*b* is mounted at an end of the rotary shaft 252*a* projecting from the conveying path 211. An endless belt 239 is tensioned on and between the pulley 252*b* and the pulley 237 mounted on the rotary shaft 231 via a pulley 238 projecting from the supporting plate 221. An endless belt 251 is tensioned between the drive and driven pulleys 252 and 253. Driving of the prime mover causes the first sandwiching roller 230, the drive pulley 252 and the endless belt 251 to rotate at the same speed.

As shown in FIG. 7, the endless belt 251 is disposed in such a manner that the conveying face 251*a* is biased with respect to the conveying path 211 from the upstream side to downstream side from the other side to the bank note guide side in a width direction.

The rotor supporting member 256 is mounted on the upper guide 222 for rotatably supporting two rotors 254 and 255 within the holes of the upper guide 222. Two rotors 254 and 255 are on one side of the endless belt 251 opposite to the drive and driven pulleys 252 and 253 and are biased toward the drive and driven pulleys 252 and 253 by an elastic force of the rotor supporting member 256.

The sandwiching force between the endless belt 251 and two rotors 254 and 255 is adjusted to be smaller than that between the first and second sandwiching rollers 230 and 240. Two rotors 254 and 255 are disposed so that they extend into the conveying path 211 through holes in the upper guide 222 for enabling the bank note to be sandwiched between them and the conveying surface 251*a* of the endless belt 251.

The spacing between the first sandwiching rollers 230 and the upstream rotor 255 of the biasing member 250 and the spacing between the second sandwiching rollers 240 and the downstream rotor 254 are made smaller than the length of bank note.

The bank note qualification detecting unit 310 will be described in detail.

The bank note qualification detecting unit 310 is provided within the exchange machine (not shown) for detecting the damage or folding of a conveyed bank note M such as a 1000 yen bank note. Since a damaged or folded bank note M is liable to be jammed on the conveying path, detection is required to prevent such a bank note M from being dispensed.

Figure 13:
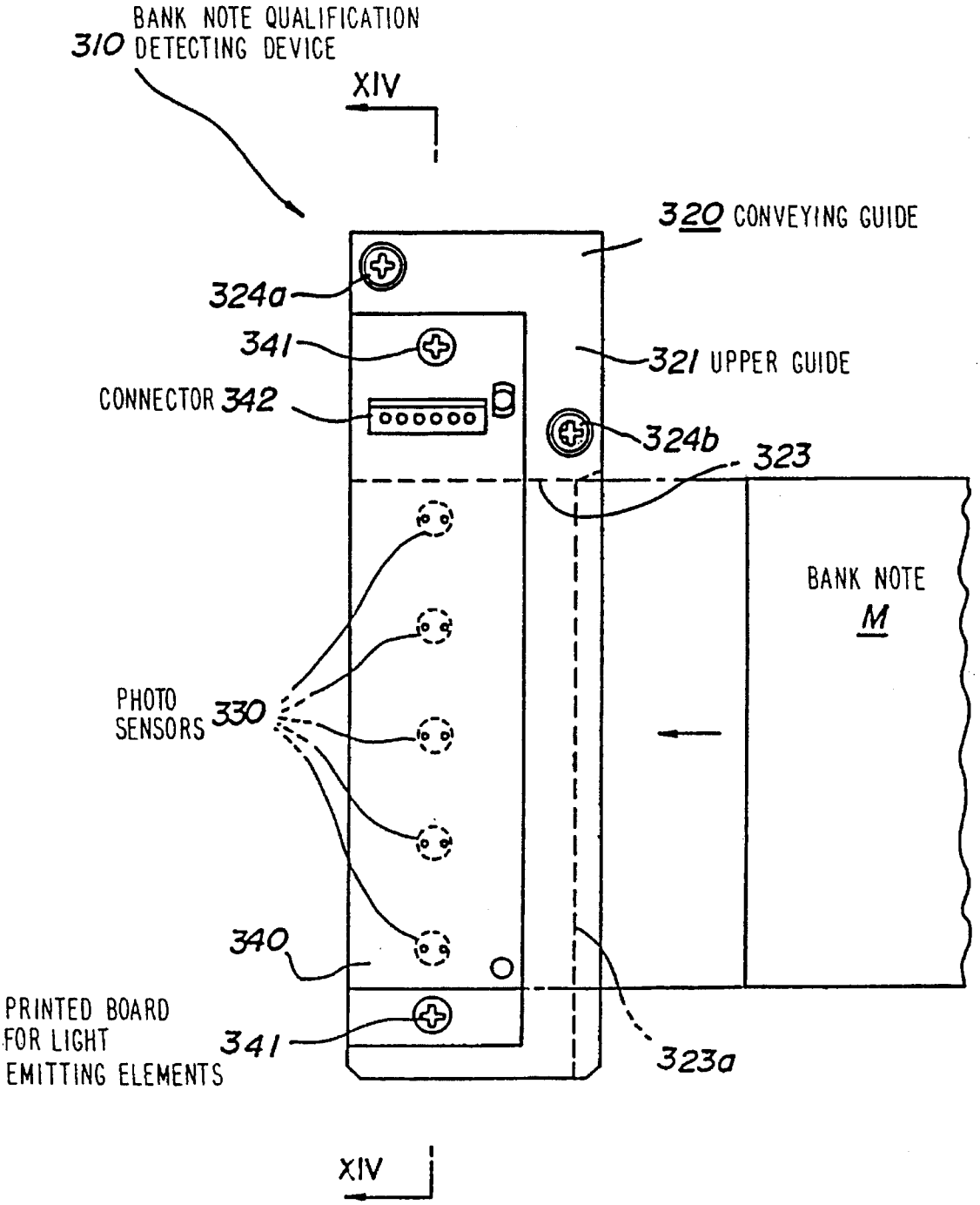
FIG. 13 is a front view showing a bank note qualification detecting unit in the embodiment of the exchange machine of the present invention.
Figure 14:
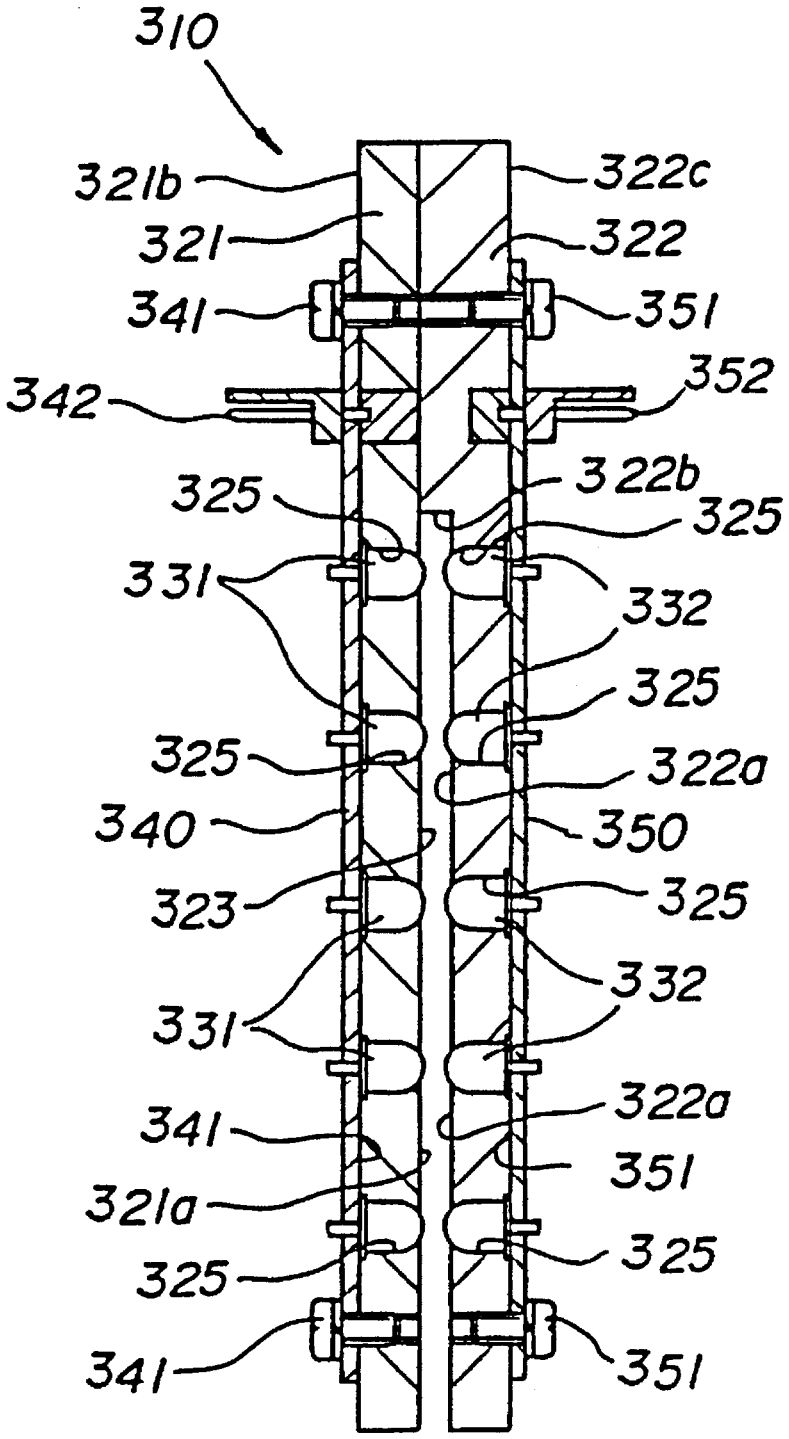
FIG. 14 is a sectional view taken along the line XIV—XIV in FIG. 13 showing the bank note qualification detecting unit in the embodiment of the exchange machine of the present invention.
Figure 15:
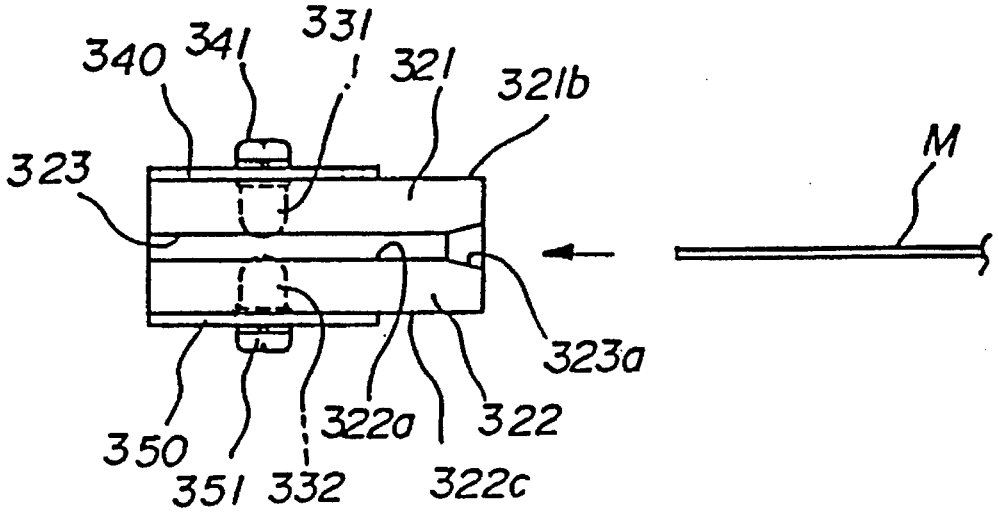
FIG. 15 Is a bottom view showing the bank not qualification detecting unit in the embodiment of the exchange machine of the present invention.

As shown in FIGS. 13 to 15, the bank note qualification detecting unit 310 comprises a conveying guide 320, a plurality of pairs of photosensors 330, a printed board 340 of light emitting elements of the photosensors 330, and a printed board 350 for light receiving elements.

The conveying guide 320 includes an upper guide 321 and a lower guide 322. The upper and lower guides 321 and 322 have the same dimension and are rectangular in shape. The lower guide 322 has a step 322*b* at one end of an inner side 322*a* thereof. The upper and lower guides 321 and 322 are joined to each other at one end of the inner side 321*a* and the step 322*b* thereof to form a bank note M conveying path 323 therebetween, other than at the step 322*b*. The upper and lower guides 321 and 322 have tapered sides at the bank note entrance side 323*a* so that the bank note is easily inserted. The conveying path 323 is opened at the other end of the upper and lower guides 321 and 322.

The upper and lower guides 321 and 322 have two internally threaded holes on the corner at one end thereof and in the vicinity of the conveying path 323. Both guides 321 and 322 are jointed by screwing externally threaded bolts 324*a*, 324*b* from the outer side 321*b* of the upper guide 321. The conveying path 323 has a width which is slightly larger than the width of the bank note M and is adapted to convey the bank note M in a longitudinal direction.

Each of the upper and lower guides 321 and 322 has 5 through-holes 325 which are aligned with each other in a width direction of the bank note M so that they face each other on the conveying path 323. Each through-hole 325 is larger on the side of the outer side 321*b*, 322*c* and is smaller on the inner side 321*b*, 322*c* so that it conforms with the shape of the photosensor 330. The through-holes 325 are disposed at equal intervals.

The photosensors 330 form 5 pairs of photo-interrupters, each pair comprising a light emitting element 331 and a light receiving element 332. Each pair of photosensors 330 detects whether or not an optical path between the light emitting element 331 and the light receiving element 332 is interrupted.

The printed board 340 for the light emitting elements has 5 light emitting elements of the photosensors 330 mounted thereon and wiring for each light emitting elements 331 printed thereon. The printed board 350 for the light receiving elements has 5 light receiving elements 332 of the photosensors 330 mounted on the inner side 351 thereof and wiring for the light emitting elements 332 printed thereon. The printed boards for light emitting and receiving elements, 340 and 350 are secured to the outer sides 321*b* and 322*c* of the upper and lower guides 321 and 322 at opposite sides thereof by means of screws 341 and 351, respectively. The printed boards for light emitting and receiving elements 340 and 350 are provided with connectors 342, 352 at one end thereof so that they project from the outer sides 321*b* and 322*c*, respectively.

As shown in FIG. 14, each light emitting element 331 of the photosensor 330 is inserted into a corresponding through-hole 325 from the outer side 321*b* of the upper guide 321 and is located on the inner side 321*a*. In such a manner, the light emitting elements 331 are aligned with each other on the inner side 321*a* of the upper guide 321 in width direction which is perpendicular to the conveying direction of bank note M.

Each of the light receiving elements 332 of the photosensor 330 is inserted into a corresponding through-hole 325 from the outer side 322*c* of the lower guide 322 and is located on the inner side 322*a*. In such a manner, the light receiving elements 332 are aligned with each other in a width direction which is normal to the conveying direction of the bank note M on the inner side 322*a* so that they face respective light emitting elements 331 across the conveying path 323.

At least conveying of the bank notes in the bank notes qualification detecting unit 310 is driven by an AC servo motor. The bank note qualification determining unit 510 in the control unit 51 determines based upon an output (a signal representing whether or not light from each photosensor 330 is interrupted) from the bank note qualification detecting unit 310, whether or not accepted bank note is reusable for controlling the conveying path switching unit 410 depending upon a result of this determination.

Specifically, as shown in FIG. 17, the bank note qualification determining unit 510 a length counter 512 for reading the output from the bank note qualification detecting unit 310 at intervals of a sampling period which is proportional to the frequency of the power supply for powering the above mentioned AC servo motor, to increment the count when at least one pair of the 5 pairs of sensors is interrupted, a qualified bank note counter which increments the count only when all 5 pairs of sensors are interrupted, a memory 513 for storing a reference value which will be described hereafter, and a determining unit 514 for comparing the counts of the counters 512 and 511 with the reference values stored in the memory 513 to determine whether or not the bank note is genuine in accordance with a predetermined rule. The determining rule is such that it is determined that the bank note is reusable when the count of the length counter is not higher than a reference value and the count of the qualified bank note counter is not less than the reference value after one bank note sheet has passed through the bank note qualification detecting unit 310 or otherwise it is determined that the bank note is abnormal.

The reference value of the length counter is preset to a value which is slightly larger than a value which is obtained by dividing the length of the bank note by a unit length at which the bank note advances for the one period (this value will be referred to as sampling value) and the reference value of the qualified bank note counter is preset slightly smaller than the sampling value. Since the count of the length counter and the count of the qualified bank note counter represent the degree of damage of a bank note, it is necessary only to appropriately determine these reference values based upon the result of experiments so that qualification of the bank note is conduced at the most preferable precision.

In the present embodiment, the bank note qualification determining unit 510 is provided to perform one of the functions of the control unit 51. Accordingly, the counters 511, 512, the memory 513 and the determining unit 514 are implemented to perform the functions of the control unit 51.

Alternatively, the bank note qualification determining unit 510 may be provided separately from the control unit 51. In this case, the bank note qualification determining unit 510 may comprise, for example, a microcomputer including a central processing unit (CPU), a memory and interfaces, etc. Alternatively, it may comprise counters, memories and logical circuits for executing a determination rule.

Now, operation will be described.

In FIG. 1, the accepting unit for recovery 21 accepts the bank notes which have been recovered by the bank note conveying machine from the plurality of game media lending machines 13 disposed in islands 11 within the game parlor 10. The bank note conveying device 210 conveys the bank notes from the accepting unit 21 to the bank note qualification detecting unit 310 via the bank note posture converting device 110. Operation of the bank note conveying device 210 and the bank note posture converting device 110 will be described hereafter in detail.

The bank note qualification determining unit 510 determines, based upon an output from the bank note qualification detecting unit 310 (a signal representing whether or not light of each photo-sensor 330 is interrupted), whether or not the accepted bank note is damaged. When it determines that the bank note is damaged, it controls the conveying path switching unit 410 for conveying the bank note from the bank note qualification detecting unit 310 to the stacking unit for recovery 22 by the conveying unit for recovery 26. Since the bank notes in the stacking unit for recovery 22 will not circulate through the game machine island 11, problems due to damage to the bank note can be positively prevented from occurring without manual handling.

When the bank note qualification determining unit 510 determines that the accepted bank note is not damaged, the bank note is conveyed from the bank note qualification detecting unit 310 to the stacking unit for exchange 23 by the conveying unit for exchange 27.

Operation of the bank note qualification detecting unit 310 and the bank note qualification determining unit 510 will be described hereafter.

When a high value bank note such as a 10000 yen note is inserted into the accepting unit 28 for exchange, the conveying unit for identification conveys the bank note from the accepting unit 28 for exchange to the bank note identifying unit 29, the bank note identifying unit 29 determines whether the bank note is genuine or not and what its denomination is. When the note is genuine, it is transferred by the conveying unit 32 for bank notes from the stacking unit 23 for exchange to the dispensing unit 31 for exchange, and a game player can receive the exchanged bank notes from the exchange dispensing unit 31.

If some of the bank notes are inserted into the game media lending machine 13, they will be circulated through the game machine island 10 again.

On the other hand the coin accepting unit 41 accepts coins which have been recovered by the coin conveying machine. The conveying unit 44 for sorting conveys the coins from the coin accepting unit 41 to the sorting unit 43 via the coin mixer 42. Sorting unit 43 sorts the coins into 100 yen and 500 yen coins depending upon the denomination. The coin stacking units 45*a*, 45*b* store the coins which are sorted by the sorting unit 43 for exchange.

The conveying unit for dispensing bank notes 32 conveys coins to the coin dispensing unit 46 from the coin stacking unit 45*a*, 45*b* when a coin selecting button is depressed if the bank note determining unit 29 determines that the accepted bank note is genuine.

Now, operation of the bank note posture converting device 110 will be described in detail.

In FIG. 3, two pairs of rollers 141*a*, 142*a* of the first conveying member 141 convey the bank note which has entered into the accepting slot 131*a* of the upstream unit 131 along the guide surface 121 of the bank note guide member 120 into the downstream first converting unit 132 which is spatially perpendicular to the upstream unit 131. The bank note is advanced in a direction which is normal to the conveying direction in the upstream unit 131 while being curved along the corner 132*a* between the upstream unit 131 and the first converting unit 132.

A pair of rollers 143*a* of the second conveying member 143 convey the bank note in the first converting unit 132 to the downstream second converting unit 133. The second converting unit 133 is twisted normally to both the upstream unit 131 and the first converting unit 132. While the bank note is conveyed from the first converting unit 132 to the second converting unit 133, it is inverted along the curve of the second converting unit 133 to change the leading sides thereof. The conveyed banknote enters into the second converting unit 133 from one of the corners and advances to the downstream unit 134 with both corners being aligned to change the leading sides. A roller 144*a* of the third conveying member 144*a* of the third conveying member 144 conveys the bank note in the second converting unit 133 to the downstream second converting unit 133.

One roller 145*a* of the fourth conveying member 145 conveys the bank note in the second converting unit 133 into the downstream unit 134 which is spatially perpendicular to the second converting unit 133. The bank note is bent at a given angle at the corner 133*a* between the second converting unit 133 to the downstream unit 134 and advances in a direction which is normal to the conveying direction of the second converting unit 133 and is then discharged from the discharge slot 134*a*. This enables the bank note to be conveyed from the accepting slot 131*a* to the discharging slot 134*a* after converting the posture.

Since the bank note posture converting device 110 is provided in the conveying path of the bank note conveying device in the exchanging machine, it is capable of easily converting the posture of the bank notes and of conveying bank notes.

The angles between the first converting unit and the upstream unit and between the second converting unit and the upstream unit and the first converting unit and between the downstream unit and the second converting unit may be other than 90 degrees if necessary.

Now, operation of the bank note conveying device 210 will be described in detail. When a bank note is placed on a conveying path 211 between the upper and lower guides 222 and 223 within the conveying guide 220 in FIG. 7, the bank note is sandwiched between the drive and driven rollers 232 and 233 of the pair of the first sandwiching roller 230 in the conveying path 211 and is moved downstream on the conveying path 211 by the rotation of the first sandwiching roller 230. The bank note is sandwiched between the conveying surface 251*a* of the endless belt 251 of the biasing member 250 and the upstream rotor 255 and is moved together with the endless belt 251 under the sandwiched condition.

The reason why the bank note is moved under the sandwiched condition is that although the rotors 254 and 255 of the biasing member 250 are in contact with the endless belt 251 by the resilient force of the rotor supporting member 256, the pressure of the rotor supporting member 256 is smaller than the sandwiching force of the first sandwiching roller 230 even if the bank note is disposed between the rotors 254, 255 and the endless belt 251 and that the conveying power of the first sandwiching roller 230 is higher than that of the biasing member 250 since the rotors 254 and 255 are in point contact with the endless belt 251.

The drive and driven pulleys 252 and 253 between which the endless belt 251 is tensioned rotate with its rotational axis being biased from the upstream side of the conveying path 211 to the downstream side thereof and in a width direction from the bank note guide's side to the other side. The endless belt 251 has the conveying surface 251*a* which is biased along the conveying path 211 from the upstream side to the downstream side thereof in a width direction from the other side to the bank note guide's side. Accordingly, after the bank note is disengaged at the rear end thereof from the first sandwiching roller 230, it changes the moving direction into the tension direction of the endless belt 251 to move toward the bank note guide 224, When the bank note is impinged upon the bank note guide 224 on the upper portion of the leading edge, the bank note changes the moving direction along the guide and advances along the conveying path 211.

At this time, the bank note is supported by two rotors 254 and 255 on two points on the side opposite to the endless belts 251. Each of the rotors 254 and 255 is rotatable in all directions and rotatably supports the bank note and rotates in a conveying direction of the bank note. Accordingly, the rollers are capable of easily changing the advancing direction of bank note and capable of correcting the orientation of the bank note even if the bank note is skewed, and is capable of conveying the bank note which is corrected in a given position.

The bank note is advanced along the bank note guide 224 with the longer sides being aligned with the bank note guide 224. When the leading edge of the bank note reaches the pair of second sandwiching rollers 240, the bank note is sandwiched between the drive and driven rollers 242 and 243 of the second sandwiching rollers 240 and is advanced in a conveying direction together with the rotation of the second sandwiching rollers 240.

Other examples of the roller will be described.

Figure 10A:
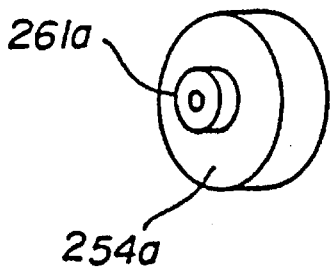
FIG. 10A is a perspective view showing an example of a rotor which is used in the bank note conveying device in the embodiment of the exchange machine of the present invention.
Figure 10B:
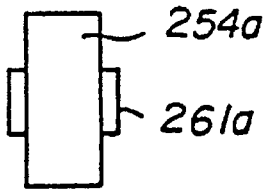
FIG. 10B is a front view of the rotor.

As shown in FIGS. 10A and 10B, which are perspective and front views, respectively, the roller may be a roller 254*a* which rotatably supports a bank note. The roller 254*a* has a bearing 261*a* so that it is rotatable. The roller 254*a* is made of a material having a low frictional coefficient and is in pressure contact with a bank note for supporting it.

Figure 11A:
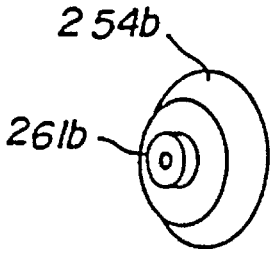
FIG. 11A is a perspective view showing a further example of a rotor which is used in the bank note conveying device in the embodiment of the exchange machine of the present invention.
Figure 11B:
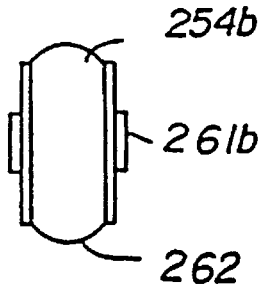
FIG. 11B is a front view of the rotor.

As shown in FIGS. 11A and 11B which are perspective and front views, respectively, the roller may be a roller 254*b* which rotatably supports a bank note. The roller 254*b* has a bearing 261*b* so that it is rotatable. The roller 254*b* has a peripheral surface 262 which is arcuate in section and is in pressure contact with a bank note for supporting it.

Figure 12A:
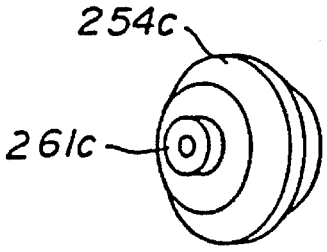
FIG. 12A is a perspective view showing another embodiment of a rotor which is used in the bank note conveying device in the embodiment of the exchange machine of the present invention.
Figure 12B:
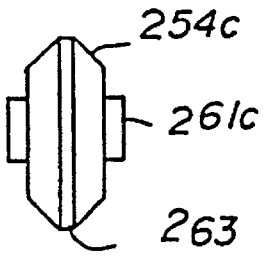
FIG. 12B is a front view of the rotor.

As shown in FIGS. 12A and 12B which are perspective and front views, respectively, the roller may be a roller 254*c* which rotatably supports a bank note. The roller 254*c* has a bearing 261*c* so that it is rotatable. The roller 254*c* has a narrow peripheral surface 263 and is in pressure contact with a bank note for supporting it.

Now, operation of the bank note qualification detecting unit 310 and the bank note qualification detecting unit 510 will be described in detail.

In FIG. 13, each light emitting element 331 of 5 pairs of photosensors 330 emits light from the inner side 321*a* of the upper guide 321 to a corresponding light receiving element 332 on the inner side 322*a* of the lower guide 322. Each light receiving unit 322 receives the emitted light.

Accordingly, when a bank note M passes through an inner conveying path 323 of the conveying guide 320 in an unfolded or untorn condition, the bank note M continues to simultaneously interrupt the light from the light emitting elements 331 of the photosensors 330 along its shorter side thereof. When the bank note M has passed through the conveying path, the light receiving elements 332 simultaneously receive the light from the light emitting elements 331. Therefore, the count of the length counter 512 is incremented at intervals of a sampling period. The count of the qualified bank note counter 511 of the bank note qualification determining unit 510 is incremented at intervals of the period. Under this condition, the counts of the length counter 512 and the genuine counter 511 are equal to the sampling value. When the count of each counter falls within the range of the reference value, the bank note qualification determining unit 510 determines that the bank note is genuine.

If the bank note M is folded or torn, the defective portion would not interrupt the light and the count of the qualified bank note counter 511 would become smaller than the sampling value depending upon the degree of defect of the bank note. If the bank note is biased with respect to the conveying direction or several bank notes are superposed, the count of the length counter 512 would become larger than the sampling number depending upon its degree. Accordingly, if the count of the counter does not fall within the range of the reference value, the bank note qualification determining unit 510 determines that the bank note is not genuine.

If it is assumed that the conveying speed of a bank note, for example a 1000 yen bank note (having a length of 150 mm), is 200 mm/sec and the sampling period of each of the counters 511, 512 is 10 msec, the unit length at which the bank note advances for the sampling period would be 2 mm and the sampling value would be 75. In other words, 75 positions of the bank note in a conveying direction which are spaced at 2 mm would be counted by the detection of 5 pairs of photosensors 330.

If the bank note is a non-defective note and is properly positioned and conveyed one by one, the counter 511 increments it count in all 75 positions and the count of the length counter 512 will not exceed 75. If there is any folded or torn portion in any of 75 positions, the number of increments of the qualified bank note counter 511 (increase in count) becomes less than 75 depending the range of the defective portion. If the bank note is biased or several bank notes are superposed, the length of the bank note exceeds 150 mm, and count of the length counter 512 would exceed 75. The reference values are preset to, for example, 70 and 80 for the qualified bank note counter 511 and the length counter 512, respectively. If there are torn portions in 5 or more than 75 positions of the bank note or the full length of the bank note in the conveying direction is 160 mm or more, the determining unit 514 would determine that the bank note is not genuine.

In such a manner, determination which is made by the bank note qualification determining unit 510 has a high precision based upon the detected value quantatively representative of the abnormality of the bank note.

Since the bank note qualification detecting unit 310 has a simple structure in which 5 pairs of photosensors 330 are aligned with each other, the manufacturing cost is low and the unit is capable of detecting a tear or breaking of a bank note M by a simple structure.

Since the light emitting elements 331 and light receiving elements 332 of the photosensors 330 are mounted on respective printed boards 340 and 350, the photosensors 330 can be mounted on the conveying guide 320 simply by mounting the printed board 340 and 350 on the outer sides 321*b* and 322*c* of the conveying guide 320, respectively. Thus, assembly is easy.

Although the embodiment in which 5 pairs of photosensors are provided has been described, the number of the photosensors may be reduced to provide a simple structure or the number the photosensors may be increased to provide a higher precision.

What is claimed is:

1. An exchange machine which uses externally accepted bank notes for exchange characterized in that said machine comprises a bank note qualification identifying unit for determining the damaged condition of an accepted bank note;

a stacking unit for exchange for accommodating bank notes for exchange;

a conveying unit for exchange for conveying to the stacking unit for exchange bank notes which are determined as undamaged by the bank note qualification identifying unit; and an exchanging unit for accepting bank notes to be exchanged and for dispensing accommodated bank notes for exchange;

said bank note qualification identifying unit including a bank note qualification detecting unit which conveys bank notes for detecting whether light is transmitted through the conveyed bank notes at a plurality of positions in a width direction with respect to the conveying direction to output a detection signal; and a bank note qualification determining unit for determining the qualification of the bank note based upon the output signal from said bank note qualification detecting unit;

said bank note qualification detecting unit including a plurality of pairs of photosensors for detecting whether or not light is transmitted through the bank note, each pair comprising a light emitting element and a light receiving element, said bank note qualification determining unit including a qualified bank note counter which reads the output signals of said photosensors at intervals of a given period to increment the count when all pairs of photosensors output off-signals; and a length counter which reads the output signals from said photosensors at intervals of a given period to increment the count when any one of the pairs of photosensors outputs an off-signal.

2. An exchange machine as defined in claim 1 characterized in that said light emitting elements are aligned in a width direction with respect to the bank note conveying direction and in that said light receiving elements are aligned in such positions that they face said light emitting elements via at least a space where a bank note is located.

3. An exchange machine as defined in claim 1 characterized in that said exchanging unit includes an accepting unit for exchange for accepting bank notes to be exchanged;

a bank note genuine or fake identifying unit for determining whether the bank note is genuine or fake;

a conveying unit for identification for conveying bank notes from said accepting unit for exchange to said bank note genuine or fake identifying unit;

a dispensing unit for exchange for dispensing exchanged bank notes;

a conveying unit for dispensing for conveying bank notes from said stacking unit for exchange to said dispensing unit for exchange when said bank note genuine or fake identifying unit determines that the accepted bank note is genuine.

4. An exchange machine as defined in claim 1 characterized in that said machine further includes a stacking unit for recovery for accommodating bank notes, which have been determined as damaged; and a conveying unit for recovery for conveying a bank note from said bank note qualification identifying unit to said stacking unit for recovery when said bank note qualification identifying unit determines that an accepted bank note is damaged.

5. An exchange machine as defined in claim 1 characterized in that said machine further includes;

an accepting unit for recovery for accepting externally conveyed bank notes; and a bank note conveying device for conveying bank notes from said accepting unit for recovery to said bank note qualification identifying unit.

6. An exchange machine as defined in claim 5 in which said machine further includes a bank note posture converting device disposed between said accepting unit for recovery and said bank note conveying device for converting the posture of the bank notes, said bank note posture converting device including a bank note guide member which constitutes a bank note conveying path; and a bank note conveying member for conveying bank notes along the bank note guide member, said bank note guide member having along the bank note conveying path in succession an upstream unit for accepting bank notes, a first converting unit and a second converting unit for converting the posture of the conveyed bank notes and a downstream unit for discharging bank notes, said first converting unit having a path which is curved with respect to said upstream unit at a given angle;

said second converting unit having a path which is spatially curved at a given angle with respect to said upstream unit and said first converting unit, said bank note conveying member including a first conveying member for conveying bank notes accepted in said accepting unit for recovery from said upstream unit to said first converting unit;

a second conveying member provided along said first converting unit for conveying bank notes from said first to second converting units;

a third conveying member provided along said second converting unit for conveying bank notes from said second converting unit to the downstream unit; and a fourth conveying member for conveying bank notes from said third conveying member to the downstream unit.

7. An exchange machine as defined in claim 5 characterized in that said bank note conveying device includes a conveying guide which constitutes said conveying path therein;

a bank note guide for forming one side of said conveying path in a width direction;

a pair of first sandwiching rollers which sandwich a paper therebetween to convey it downstream of the conveying path;

a pair of second sandwiching rollers which are disposed in a position displaced in a width direction of the conveyed bank note and downstream of said first sandwiching rollers for further advancing the bank note by rotating with the bank note being sandwiched therebetween; and a biasing member provided between the first and second sandwiching rollers for attracting the bank note discharged from the first sandwiching roller to convey it to the second sandwiching rollers while displacing the bank note in a width direction.

8. An exchange machine as defined in claim 7 characterized in that said biasing member includes an endless belt;

drive and driven pulleys rotatably mounted on said conveying guide between which the endless belt is tensioned;

two rotors which are disposed in such a manner that they are capable of sandwiching a bank note between them and the conveying surface of said endless belt; and a rotor supporting member mounted on said conveying guide for rotatably supporting the two rotors;

said drive and driven pulleys having their axes of rotation which are biased with respect to the conveying path from the upstream to the downstream side and from the side of the bank note guide to the other side in a width direction thereof;

said endless belt being disposed in such manner that said conveying surface is biased with respect to said conveying path from upstream to downstream side and from the other side to the side of the bank note guide in a width direction.

9. An exchange machine as defined in claim 8 characterized in that the spacing between said first and second sandwiching rollers is longer than the length of said bank note;

the spacings between the upstream rotor of said biasing member and said first sandwiching rollers and between the downstream rotor and said second sandwiching rollers are shorter than the length of said bank note.

10. An exchange machine as defined in claim 9 characterized in that said rotors comprise either balls or rollers which rotatably support a bank note.

11. An exchange machine as defined in claim 2 characterized in that said machine further includes a printed board for light emitting elements of said photosensors; and a printed board for light receiving elements of said photosensors;

the light emitting elements of a plurality of pairs of photosensors being mounted on the printed board for the light emitting elements; and the light receiving elements of a plurality of pairs of photosensors being mounted on the printed board for the light receiving elements.

12. A bank note qualification identifying device for determining the damaged condition of an accepted bank note comprising a bank note qualification detecting unit which conveys bank notes for detecting whether light is transmitted through the conveyed bank notes at a plurality of positions in a width direction with respect to the conveying direction to output a detection signal; and a bank note qualification determining unit for determining qualification of the bank note based upon the output signal from said bank note qualification detecting unit;

said bank note qualification detecting unit including a plurality of pairs of photosensors for detecting whether or not light is transmitted through the bank note, each pair comprising a light emitting element and a light receiving element, said bank note qualification determining unit including a qualified bank note counter which reads the output signals of said photosensors at intervals of a given period of increment the count when all pairs of photosensors output off-signals; and a length counter which reads the output signals from said photosensors at intervals of a given period to increment the count when any one of the pairs of photosensors outputs an off-signal.

13. A bank note qualification identifying device as defined in claim 12 characterized in that said light emitting elements are aligned in a width direction with respect to the bank note conveying direction and in that said light receiving elements are aligned in such positions that they face said light emitting elements via at least a space where a bank note is located.

14. A bank note qualification identifying device as defined in claim 13 characterized in that said bank note qualification detecting unit further includes a printed board for light emitting elements of said photosensors; and a printed board for light receiving elements of said photosensors;

the light emitting elements of a plurality of pairs of photosensors being mounted on the printed board for the light emitting elements;

the light receiving elements of a plurality of pairs of photosensors being mounted on the printed board for the light receiving elements.

* * * * *